US008573981B2

(12) United States Patent
Morag

(10) Patent No.: US 8,573,981 B2
(45) Date of Patent: Nov. 5, 2013

(54) TRAINING SYSTEM FOR AN ARTICLE OF FOOTWEAR WITH A BALL CONTROL PORTION

(75) Inventor: Erez Morag, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 621 days.

(21) Appl. No.: 12/824,753

(22) Filed: Jun. 28, 2010

(65) Prior Publication Data

US 2010/0331122 A1 Dec. 30, 2010

Related U.S. Application Data

(63) Continuation-in-part of application No. 12/474,852, filed on May 29, 2009, now Pat. No. 8,196,322.

(51) Int. Cl.
*G09B 19/00* (2006.01)

(52) U.S. Cl.
USPC ..... 434/251

(58) Field of Classification Search
None
See application file for complete search history.

(56) References Cited

U.S. PATENT DOCUMENTS

| | | | | |
|---|---|---|---|---|
| D15,185 | S | 8/1884 | Brooks | |
| 830,324 | A | 9/1906 | Hunt | |
| 950,333 | A | 2/1910 | Koch | |
| 1,087,212 | A | 2/1914 | Caldwell | |
| 1,184,013 | A | 5/1916 | Pierce | |
| 1,361,078 | A | 12/1920 | Lynn | |
| 1,469,766 | A | 10/1923 | Blair | |
| 1,559,114 | A | 10/1925 | Maranville | |
| D81,917 | S | 9/1930 | Burchfield | |
| 2,087,945 | A | 7/1937 | Butler | |
| 2,095,095 | A | 10/1937 | Howard | |
| 2,185,397 | A | 1/1940 | Birchfield | |
| 2,187,430 | A | 1/1940 | Olmsted et al. | |
| 2,350,879 | A | 6/1944 | Daniels | |
| D171,130 | S | 12/1953 | Gruner | |
| 2,918,734 | A | 12/1959 | Hyde | |
| 2,941,527 | A | 6/1960 | Scholl | |
| 2,969,062 | A | 1/1961 | Landau | |
| 3,043,026 | A | 7/1962 | Semon | |
| 3,063,171 | A | 11/1962 | Hollander | |
| 3,063,555 | A | 11/1962 | Hanington | |
| 3,091,871 | A * | 6/1963 | Tronche | 36/72 R |
| D201,865 | S | 8/1965 | Bingham, Jr. et al. | |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

Pending U.S. Appl. No. 13/234,182, filed Sep. 16, 2011.

(Continued)

*Primary Examiner* — Kurt Fernstrom
*Assistant Examiner* — Dolores Collins
(74) *Attorney, Agent, or Firm* — Plumsea Law Group, LLC

(57) ABSTRACT

A training system for an article of footwear is disclosed. The training system includes a method of training an athlete to use an article of footwear with a ball control portion to help enhance accuracy when kicking a ball. The method can be implemented on a computer, mobile device or as an instruction booklet. The training system provides a total training solution for an athlete that is designed to enhance specific athletic skills.

20 Claims, 13 Drawing Sheets

(56) References Cited

U.S. PATENT DOCUMENTS 3,253,591 A 5/1966 Scholl
3,325,919 A 6/1967 Robinson
3,328,901 A 7/1967 Strickland
3,341,952 A 9/1967 Dassler
3,352,034 A 11/1967 Braun
3,419,974 A 1/1969 Lange
D213,416 S 3/1969 Dittmar
3,481,820 A 12/1969 Jonas
D219,503 S 12/1970 Vietas
3,548,420 A 12/1970 Spence
3,597,863 A 8/1971 Austin et al.
3,619,916 A 11/1971 Neri
3,631,614 A 1/1972 Rice
3,649,967 A 3/1972 Millman
3,656,245 A 4/1972 Wilson
3,668,793 A 6/1972 Stohr et al.
3,693,270 A 9/1972 Murray
3,703,775 A 11/1972 Gatti
3,775,874 A 12/1973 Bonneville
3,858,337 A 1/1975 Vogel
3,951,407 A 4/1976 Calacurcio
4,065,861 A 1/1978 Pelfrey
4,084,265 A 4/1978 Anfelt
4,096,649 A 6/1978 Saurwein
4,107,858 A 8/1978 Bowerman et al.
4,146,979 A 4/1979 Fabbrie
4,204,346 A 5/1980 Fugere
4,210,245 A 7/1980 Dodge
4,245,406 A 1/1981 Landay et al.
4,315,374 A 2/1982 Sneeringer
4,335,530 A 6/1982 Stubblefield
4,342,159 A 8/1982 Edwards
4,347,674 A 9/1982 George
4,375,728 A 3/1983 Dassler
4,375,729 A 3/1983 Buchanen, III
4,385,456 A 5/1983 Livernois et al.
4,392,312 A 7/1983 Crowley et al.
D271,159 S 11/1983 Muller-Feigelstock
D272,200 S 1/1984 Autry et al.
4,428,089 A 1/1984 Dawber et al.
D272,772 S 2/1984 Kohno
4,452,289 A 6/1984 Smith
4,454,662 A 6/1984 Stubblefield
D278,759 S 5/1985 Norton et al.
4,534,122 A 8/1985 MacPhail
4,574,498 A 3/1986 Norton et al.
4,577,625 A 3/1986 Lohati et al.
4,586,274 A 5/1986 Blair
D287,662 S 1/1987 Tonkel
4,633,600 A 1/1987 Dassler et al.
4,667,425 A 5/1987 Effler et al.
4,674,200 A 6/1987 Sing
4,689,901 A 9/1987 Ihlenburg
4,698,923 A 10/1987 Arff
4,703,445 A 10/1987 Dassler
4,715,133 A 12/1987 Hartjes et al.
4,726,126 A 2/1988 Bernhard
D294,655 S 3/1988 Heyes
D295,231 S 4/1988 Heyes
4,771,394 A 9/1988 Cavanagh
4,819,795 A 4/1989 Swaney
4,825,552 A 5/1989 Bendickson et al.
4,833,796 A 5/1989 Flemming
4,858,343 A 8/1989 Flemming
4,873,774 A 10/1989 Lafever
4,893,519 A 1/1990 Corso et al.
4,951,533 A 8/1990 Hillinger
5,025,573 A 6/1991 Giese et al.
5,056,945 A 10/1991 Klodt
D323,217 S 1/1992 Holden
5,092,347 A 3/1992 Shaffer et al.
5,174,049 A 12/1992 Flemming
5,201,126 A 4/1993 Tanel
5,203,793 A 4/1993 Lyden
5,216,827 A 6/1993 Cohen
5,221,379 A 6/1993 Nicholas
D339,459 S 9/1993 Yoshikawa et al.
5,289,647 A 3/1994 Mercer
5,299,369 A 4/1994 Goldman
D347,709 S 6/1994 Pearson
5,335,429 A 8/1994 Hansen
5,339,544 A 8/1994 Caberlotto
5,343,445 A 8/1994 Cherdak
5,351,422 A 10/1994 Fitzgerald
5,367,791 A 11/1994 Gross et al.
5,383,290 A 1/1995 Grim
5,384,973 A 1/1995 Lyden
5,392,534 A 2/1995 Grim
5,406,723 A 4/1995 Okajima
5,410,823 A 5/1995 Lyoob
5,419,014 A 5/1995 Piantedosi
5,433,437 A 7/1995 Dudley
5,452,269 A 9/1995 Cherdak
5,452,526 A 9/1995 Collins
5,461,801 A 10/1995 Anderton
5,473,827 A 12/1995 Barre et al.
5,491,015 A 2/1996 Reeves et al.
D368,156 S 3/1996 Longbottom et al.
5,500,956 A 3/1996 Schulkin et al.
D368,360 S 4/1996 Wolfe
D369,672 S 5/1996 Tanaka et al.
5,513,451 A 5/1996 Kataoka et al.
5,524,637 A 6/1996 Erickson
5,526,589 A 6/1996 Jordan
5,530,626 A 6/1996 Norment
5,555,650 A 9/1996 Longbottom et al.
5,572,739 A 11/1996 Kolada et al.
5,572,807 A 11/1996 Kelly et al.
5,592,759 A 1/1997 Cox
5,617,650 A 4/1997 Grim
5,617,653 A 4/1997 Walker et al.
5,629,186 A 5/1997 Yasukawa et al.
5,634,283 A 6/1997 Kastner
5,634,284 A 6/1997 MacPhail
5,669,833 A * 9/1997 Stone ..... 473/422
D387,892 S 12/1997 Briant
5,692,322 A 12/1997 Lombardino
D389,298 S 1/1998 Briant
5,709,954 A 1/1998 Lyden et al.
5,737,858 A * 4/1998 Levy ..... 36/128
5,740,618 A 4/1998 Minden
D394,943 S 6/1998 Campbell et al.
5,766,704 A 6/1998 Allen et al.
5,775,010 A 7/1998 Kaneko
5,806,209 A 9/1998 Crowley et al.
5,815,951 A 10/1998 Jordan
5,827,459 A 10/1998 Allen et al.
5,832,636 A 11/1998 Lyden et al.
5,878,378 A 3/1999 Brommer et al.
5,882,205 A * 3/1999 Peterson ..... 434/251
5,887,371 A 3/1999 Curley, Jr.
5,897,446 A 4/1999 Wiseman et al.
5,929,332 A 7/1999 Brown
5,939,157 A 8/1999 Allen et al.
5,946,828 A 9/1999 Jordan et al.
5,947,845 A 9/1999 Canelas
5,955,159 A 9/1999 Allen et al.
5,956,871 A 9/1999 Korsen
D415,340 S 10/1999 McMullin
5,979,083 A 11/1999 Robinson et al.
5,983,529 A 11/1999 Serna
5,985,383 A 11/1999 Allen et al.
5,987,783 A 11/1999 Allen et al.
6,016,613 A 1/2000 Campbell et al.
D421,833 S 3/2000 Fallon
6,035,559 A 3/2000 Freed et al.
6,079,127 A 6/2000 Nishimura et al.
D427,754 S 7/2000 Portaud
6,099,936 A 8/2000 Kashihara
6,101,746 A 8/2000 Evans
6,112,433 A 9/2000 Greiner
6,125,556 A 10/2000 Peckler et al.
6,145,221 A 11/2000 Hockerson
6,161,315 A 12/2000 Dalton

(56) References Cited

U.S. PATENT DOCUMENTS

D437,108 S 2/2001 Peabody
D437,989 S 2/2001 Cass
6,195,917 B1 3/2001 Dieckhaus
6,199,303 B1 3/2001 Luthi et al.
6,213,298 B1 4/2001 Nguyen
6,231,946 B1 5/2001 Brown, Jr. et al.
6,256,907 B1 7/2001 Jordan et al.
6,270,432 B1 8/2001 Matlock
6,312,361 B1 11/2001 Hayes
6,315,571 B1 11/2001 Lee
6,357,146 B1 3/2002 Wordsworth et al.
6,389,714 B1 5/2002 Mack
6,405,606 B1 6/2002 Walczyk et al.
6,408,542 B1 6/2002 Shepherd
D461,297 S 8/2002 Lancon
6,442,875 B1 9/2002 Joubert et al.
6,481,122 B2 11/2002 Brahler
D468,517 S 1/2003 Recchi et al.
6,523,282 B1 2/2003 Johnston
6,543,158 B2 4/2003 Dieckhaus
6,550,160 B2 4/2003 Miller, II
D477,905 S 8/2003 Adams et al.
D478,714 S 8/2003 Recchi
6,618,962 B1 9/2003 Covatch
6,647,549 B2 11/2003 McDevitt et al.
6,647,647 B2 11/2003 Auger et al.
6,671,981 B2 1/2004 Brooks
6,675,505 B2 1/2004 Terashima
6,698,110 B1 3/2004 Robbins
6,708,427 B2 3/2004 Sussmann et al.
6,725,574 B2 4/2004 Hokkirigawa et al.
6,739,075 B2 5/2004 Sizemore
6,754,984 B2 6/2004 Schaudt et al.
D495,122 S 8/2004 McMullin
6,808,462 B2 10/2004 Snyder et al.
6,834,446 B2 12/2004 McMullin
6,892,479 B2 5/2005 Auger et al.
6,904,707 B2 6/2005 McMullin
6,915,595 B2 7/2005 Kastner
6,915,596 B2 7/2005 Grove et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
7,028,419 B2 4/2006 Brooks
D525,416 S 7/2006 Auger et al.
7,143,530 B2 12/2006 Hudson et al.
7,155,846 B2 1/2007 Alfaro et al.
7,172,521 B1 2/2007 Novis
7,181,868 B2 2/2007 Auger et al.
7,188,439 B2 3/2007 DiBenedetto et al.
7,194,826 B2 3/2007 Ungari
7,234,250 B2 6/2007 Fogarty et al.
7,241,234 B2 7/2007 Eite
7,254,909 B2 8/2007 Ungari
7,269,916 B2 9/2007 Biancucci et al.
7,287,343 B2 10/2007 Healy
7,292,867 B2 11/2007 Werner et al.
7,329,448 B2 2/2008 Cunningham
7,355,519 B2 4/2008 Grold et al.
7,370,439 B1 5/2008 Myers
D571,092 S 6/2008 Norton
D571,542 S 6/2008 Wilken
7,386,948 B2 6/2008 Sink
D573,779 S 7/2008 Stauffer
7,401,418 B2 7/2008 Wyszynski et al.
D575,041 S 8/2008 Wilken
7,406,781 B2 8/2008 Scholz
7,409,783 B2 8/2008 Chang
D578,280 S 10/2008 Wilken
7,430,819 B2 10/2008 Auger et al.
7,441,350 B2 10/2008 Auger et al.
7,490,418 B2 2/2009 Obeydani
7,497,035 B2 * 3/2009 Kos et al. ..... 36/133
7,536,810 B2 5/2009 Jau et al.
7,559,160 B2 7/2009 Kelly
7,575,433 B2 8/2009 Shibata et al.
7,579,946 B2 8/2009 Case, Jr.
7,581,643 B2 9/2009 Wilskey et al.
7,584,554 B2 9/2009 Fogarty et al.
7,596,891 B2 10/2009 Carnes et al.
7,650,707 B2 1/2010 Campbell et al.
D609,436 S 2/2010 Flint
7,654,013 B2 2/2010 Savoie et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,707,748 B2 5/2010 Campbell
7,727,608 B2 6/2010 Cunningham
7,762,009 B2 7/2010 Gerber
7,784,196 B1 8/2010 Christensen et al.
7,866,064 B2 1/2011 Gerber
D632,466 S 2/2011 Kasprzak
7,941,943 B2 5/2011 Baker et al.
7,942,784 B1 5/2011 Hyde et al.
7,984,569 B2 7/2011 Chaney et al.
7,997,007 B2 8/2011 Sanabria-Hernandez
8,043,173 B2 10/2011 Menalagha et al.
8,079,160 B2 12/2011 Baucom et al.
8,122,617 B1 2/2012 Dixon et al.
8,196,321 B2 * 6/2012 Baker et al. ..... 36/133
8,196,322 B2 * 6/2012 Atsumi et al. ..... 36/133
8,246,494 B2 * 8/2012 Stephenson ..... 473/446
8,251,207 B2 8/2012 Baker et al.
8,256,145 B2 9/2012 Baucom et al.
8,257,228 B2 9/2012 Quatrochi et al.
8,262,515 B2 * 9/2012 Morris ..... 473/420
8,286,619 B2 * 10/2012 Mihaljevic ..... 124/16
2001/0022039 A1 9/2001 Krajcir
2002/0017036 A1 2/2002 Berger et al.
2002/0029496 A1 3/2002 Morle
2002/0078603 A1 6/2002 Schmitt, Jr.
2002/0100190 A1 8/2002 Pellerin
2002/0178619 A1 12/2002 Schaudt et al.
2003/0033731 A1 2/2003 Sizemore
2003/0188458 A1 10/2003 Kelly
2004/0000075 A1 1/2004 Auger et al.
2004/0035024 A1 2/2004 Kao
2004/0046692 A1 3/2004 Robson et al.
2004/0088888 A1 5/2004 Johnston
2004/0187356 A1 9/2004 Patton
2004/0250451 A1 12/2004 McMullin
2005/0016023 A1 1/2005 Burris
2005/0016029 A1 1/2005 Auger et al.
2005/0072026 A1 4/2005 Sink
2005/0097783 A1 5/2005 Mills et al.
2005/0108898 A1 5/2005 Jeppesen et al.
2005/0120593 A1 6/2005 Mason
2005/0144812 A1 7/2005 Wheeler
2005/0217149 A1 10/2005 Ho
2005/0221919 A1 10/2005 Eite
2005/0257405 A1 11/2005 Kilgore
2005/0268490 A1 12/2005 Foxen
2006/0016101 A1 1/2006 Ungari
2006/0021254 A1 2/2006 Jones
2006/0021255 A1 2/2006 Auger et al.
2006/0026528 A1 2/2006 Paulsen et al.
2006/0042124 A1 3/2006 Mills et al.
2006/0130372 A1 6/2006 Auger et al.
2006/0218821 A1 * 10/2006 Hatzilias ..... 36/133
2006/0242863 A1 11/2006 Patmore
2007/0039209 A1 2/2007 White et al.
2007/0199211 A1 8/2007 Campbell
2007/0199213 A1 8/2007 Campbell et al.
2007/0227047 A1 * 10/2007 Zaza ..... 36/133
2007/0261271 A1 11/2007 Krouse
2007/0266597 A1 11/2007 Jones
2008/0009275 A1 1/2008 Werner et al.
2008/0010863 A1 1/2008 Auger et al.
2008/0059064 A1 3/2008 Werner et al.

(56) References Cited

U.S. PATENT DOCUMENTS

| | | | | |
|---|---|---|---|---|
| 2008/0066348 | A1 | 3/2008 | O'Brien et al. | |
| 2008/0098624 | A1 | 5/2008 | Goldman | |
| 2008/0127520 | A1 | 6/2008 | Luedecke et al. | |
| 2008/0196276 | A1 | 8/2008 | McMullin | |
| 2008/0214360 | A1 | 9/2008 | Stirling et al. | |
| 2008/0216352 | A1 | 9/2008 | Baucom et al. | |
| 2008/0218310 | A1 | 9/2008 | Alten et al. | |
| 2008/0293023 | A1* | 11/2008 | Diehl et al. | 434/248 |
| 2008/0319661 | A1 | 12/2008 | Werner et al. | |
| 2009/0019732 | A1 | 1/2009 | Sussmann | |
| 2009/0047645 | A1 | 2/2009 | Dibenedetto et al. | |
| 2009/0048044 | A1 | 2/2009 | Oleson et al. | |
| 2009/0048070 | A1 | 2/2009 | Vincent et al. | |
| 2009/0056169 | A1 | 3/2009 | Robinson, Jr. et al. | |
| 2009/0056172 | A1 | 3/2009 | Cho | |
| 2009/0077832 | A1 | 3/2009 | Flint | |
| 2009/0100711 | A1 | 4/2009 | Engel | |
| 2009/0100716 | A1 | 4/2009 | Gerber | |
| 2009/0100718 | A1 | 4/2009 | Gerber | |
| 2009/0113758 | A1 | 5/2009 | Nishiwaki et al. | |
| 2009/0113766 | A1 | 5/2009 | Hooper | |
| 2009/0124434 | A1 | 5/2009 | Abboud | |
| 2009/0126230 | A1 | 5/2009 | McDonald et al. | |
| 2009/0223088 | A1 | 9/2009 | Krikorian et al. | |
| 2009/0241370 | A1 | 10/2009 | Kimura | |
| 2009/0241377 | A1 | 10/2009 | Kita et al. | |
| 2009/0272008 | A1 | 11/2009 | Nomi et al. | |
| 2009/0284368 | A1 | 11/2009 | Case, Jr. | |
| 2009/0293315 | A1 | 12/2009 | Auger et al. | |
| 2009/0307933 | A1 | 12/2009 | Leach | |
| 2010/0050471 | A1 | 3/2010 | Kim | |
| 2010/0077635 | A1 | 4/2010 | Baucom et al. | |
| 2010/0083541 | A1 | 4/2010 | Baucom et al. | |
| 2010/0126044 | A1 | 5/2010 | Davis | |
| 2010/0199523 | A1 | 8/2010 | Mayden et al. | |
| 2010/0212190 | A1 | 8/2010 | Schmid | |
| 2010/0229427 | A1 | 9/2010 | Campbell et al. | |
| 2010/0251578 | A1 | 10/2010 | Auger et al. | |
| 2010/0275463 | A1 | 11/2010 | Gallagher | |
| 2010/0299961 | A1 | 12/2010 | Baker et al. | |
| 2010/0299967 | A1 | 12/2010 | Atsumi et al. | |
| 2010/0304346 | A1* | 12/2010 | Morag | 434/258 |
| 2010/0313447 | A1 | 12/2010 | Becker et al. | |
| 2010/0331122 | A1 | 12/2010 | Morag | |
| 2011/0045926 | A1 | 2/2011 | Morag et al. | |
| 2011/0047830 | A1 | 3/2011 | Francello et al. | |
| 2011/0078922 | A1 | 4/2011 | Cavaliere et al. | |
| 2011/0078927 | A1 | 4/2011 | Baker | |
| 2011/0088287 | A1 | 4/2011 | Auger et al. | |
| 2011/0126426 | A1 | 6/2011 | Amark | |
| 2011/0167676 | A1 | 7/2011 | Benz et al. | |
| 2011/0197475 | A1 | 8/2011 | Weidl et al. | |
| 2011/0197478 | A1 | 8/2011 | Baker | |
| 2011/0203136 | A1 | 8/2011 | Auger | |
| 2012/0052987 | A1* | 3/2012 | Goodman | 473/422 |
| 2012/0107781 | A1* | 5/2012 | Morag et al. | 434/247 |
| 2012/0180343 | A1 | 7/2012 | Auger et al. | |
| 2012/0277891 | A1 | 11/2012 | Aragones et al. | |

FOREIGN PATENT DOCUMENTS

| | | |
|---|---|---|
| DE | 1809860 | 4/1960 |
| DE | 2721410 | 11/1978 |
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 0115663 | 8/1984 |
| EP | 115663 | 8/1984 |
| EP | 0123550 | 10/1984 |
| EP | 123550 | 10/1984 |
| EP | 0223700 | 5/1987 |
| EP | 340053 | 11/1989 |
| EP | 0723745 | 7/1996 |
| EP | 1025771 | 8/2000 |
| EP | 1430801 | 6/2004 |
| EP | 1714571 | 10/2006 |
| EP | 1839511 | 10/2007 |
| EP | 2057913 | 5/2009 |
| EP | 2499928 | 9/2012 |
| FR | 1554061 | 1/1969 |
| FR | 2567004 | 1/1986 |
| FR | 2818876 | 7/2002 |
| GB | 1329314 | 9/1973 |
| GB | 2020161 | 11/1979 |
| GB | 2113971 | 8/1983 |
| GB | 2256784 | 12/1992 |
| GB | 2377616 | 1/2003 |
| GB | 2413052 | 10/2005 |
| GB | 2425706 | 11/2006 |
| JP | 9209206 | 8/1997 |
| JP | 9253266 | 9/1997 |
| JP | 10000105 | 1/1998 |
| JP | 10066605 | 3/1998 |
| JP | 63256704 | 10/1998 |
| JP | 11276204 | 10/1999 |
| JP | 2002272506 | 9/2002 |
| JP | 2002306207 | 10/2002 |
| JP | 2004024811 | 1/2004 |
| JP | 2005185303 | 7/2005 |
| JP | 2005304653 | 11/2005 |
| TW | 540323 | 7/2003 |
| TW | 540323 U | 7/2003 |
| TW | M267886 | 6/2005 |
| TW | M267886 U | 6/2005 |
| WO | WO 2010036988 | 4/1986 |
| WO | 0053047 | 9/2000 |
| WO | 03045182 | 6/2003 |
| WO | 03071893 | 9/2003 |
| WO | WO 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | WO 2009110822 | 9/2009 |
| WO | 2010036988 | 4/2010 |
| WO | 2010057207 | 5/2010 |
| WO | 2012150971 | 11/2012 |

OTHER PUBLICATIONS

Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 12/582,252, filed Oct. 20, 2009.
Pending U.S. Appl. No. 13/234,233, filed Sep. 16, 2011.
International Search Report and Written Opinion mailed Jun. 13, 2012 in International Application No. PCT/US2012/021663.
Office Action mailed Jun. 13, 2012 in U.S. Appl. No. 12/582,252.
Response to Office Action filed Sep. 12, 2012 in U.S. Appl. No. 12/582,252.
Notice of Allowance mailed Sep. 20, 2012 in U.S. Appl. No. 12/582,252.
International Search Report and Written Opinion for PCT/US2011/045356 dated Dec. 16, 2011.
International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug Web Page (date based on information from Internet Archive).
Dec. 23, 2008, Icebug Web Page (date based on information from Internet Archive).
International Search Report for PCT/US2010/050637 dated Jan. 14, 2011.
Partial Search Report for PCT/US2009/058522 dated Mar. 4, 2010.

(56) References Cited

OTHER PUBLICATIONS

U.S. Appl. No. 12/239,190, filed Sep. 26, 2008.
U.S. Appl. No. 12/566,792, filed Sep. 25, 2009.
U.S. Appl. No. 12/711,107, filed Feb. 23, 2010.
U.S. Appl. No. 12/708,411, filed Feb. 18, 2010.
U.S. Appl. No. 12/572,154, filed Oct. 1, 2009.
International Search Report for PCT/US2009/058522 dated Feb. 17, 2010.
International Search Report for PCT/US2010/029640 dated May 17, 2010.
Pending U.S. Appl. No. 13/561,608, filed Jul. 30, 2012.
Pending U.S. Appl. No. 13/561,557, filed Jul. 30, 2012.
Invitation to Pay Additional Fees and, Where Applicable, Protest Fee mailed Jan. 7, 2013 in International Application No. PCT/US2012/052968.
Invitation to Pay Additional Fees and, Where Applicable, Protest Fee mailed Jan. 8, 2013 in International Application No. PCT/US2012/052970.
Invitation to Pay Additional Fees and, Where Applicable, Protest Fee mailed Jan. 7, 2013 in International Application No. PCT/US2012/052965.
International Search Report and Written Opinion mailed Jan. 22, 2013 in International Application No. PCT/US2012/052972.
Invitation to Pay Additional Fees and, Where Applicable, Protest Fee mailed Feb. 8, 2013 in International Application No. PCT/US2012/052963.
Pending U.S. Appl. No. 13/582,252, filed Oct. 20, 2009.
Pending U.S. Appl. No. 13/234,180, filed Sep. 16, 2011.
International Search Report and Written Opinion mailed Jun. 7, 2010 in PCT Application No. PCT/US2009/058522.
International Search Report and Written Opinion mailed May 24, 2010 in PCT Application No. PCT/US2010/029640.
U.S. Appl. No. 12/636,427, filed Dec. 11, 2009.
U.S. Appl. No. 12/824,768, filed Jun. 28, 2010.
International Search Report and Written Opinion mailed Mar. 15, 2011 in International Application No. PCT/US2010/034821.
International Preliminary Report on Patentability (including Written Opinion of the ISA) mailed Dec. 8, 2011 in International Application No. PCT/US2010/034821.
Invitation to Pay Additional Fees and International Search Report, mailed Nov. 19, 2010 in International Application No. PCT/US2010/036495.
International Search Report and Written Opinion of The International Searching Authority mailed Jan. 18, 2011 in International Application No. PCT/US2010/036495.
International Preliminary Report on Patentability (including Written Opinion of the ISA) mailed Dec. 8, 2011 in International Application No. PCT/US2010/036495.
Response to Final Office Action filed on May 10, 2013 in U.S. Appl. No. 12/636,427.
Office Action mailed Aug. 22, 2012 in U.S. Appl. No. 12/636,427.
Response to Office Action filed Nov. 21, 2012 in U.S. Appl. No. 12/636,427.
Final Office Action mailed Feb. 20, 2013 in U.S. Appl. No. 12/636,427.
Office Action mailed Dec. 6, 2012 in U.S. Appl. No. 12/916,958.
Response to Office Action filed Mar. 6, 2013 in U.S. Appl. No. 12/916,958.
Office Action mailed Sep. 26, 2012 in U.S. Appl. No. 12/752,318.
Response to Office Action filed Dec. 27, 2012 in U.S. Appl. No. 12/752,318.
Notice of Allowance mailed Feb. 7, 2013 in U.S. Appl. No. 12/752,318.
Voluntary Amendment filed Sep. 20, 2012 in Chinese Application No. 201080033231.2 and English translation thereof.
Voluntary Amendment filed Nov. 22, 2012 in Chinese Application No. 201080033236.5 and English translation thereof.
Office Action mailed Jan. 22, 2013 in U.S. Appl. No. 12/824,768.
Response to Office Action filed Apr. 22, 2013 in U.S. Appl. No. 12/824,768.
Voluntary Amendments filed Sep. 20, 2012 in Chinese Patent Application No. 201080033231.2 with English-language translation.
Voluntary Amendments filed Nov. 22, 2012 in Chinese Patent Application No. 201080033236.5 with English-language translation.
International Search Report and Written Opinion mailed Mar. 8, 2013 in International Application No. PCT/US2012/052965.
International Search Report and Written Opinion mailed Mar. 8, 2013 in International Application No. PCT/US2012/052968.
International Search Report and Written Opinion mailed Mar. 8, 2013 in International Application No. PCT/US2012/052970.
Office Action mailed May 23, 2013 in U.S. Appl. No. 12/636,427.
Notice of Allowance mailed May 10, 2013 in U.S. Appl. No. 12/916,958.
Notice of Allowance mailed Aug. 22, 2013 in U.S. Appl. No. 12/824,768.

* cited by examiner

TRAINING SYSTEM FOR AN ARTICLE OF FOOTWEAR WITH A BALL CONTROL PORTION

CROSS REFERENCE TO RELATED APPLICATION

This application is a continuation-in-part of Atsumi et al., U.S. Pat. No. 8,196,322, (currently U.S. application Ser. No. 12/474,852, entitled "Article of Footwear with Ball Control Portion", filed on May 29, 2009) which is incorporated herein by reference in its entirety.

BACKGROUND

The present invention relates generally to an article of footwear, and in particular to a training system for an article of footwear.

Maranville (U.S. Pat. No. 1,559,114) teaches a series of nubs that are arranged in a generally oval configuration in several areas on a rubber glove to increase grip. Kolada (U.S. Pat. No. 5,572,739) teaches a baseball glove that includes protrusions made of an elastomeric material that improve a user's grip on a ball that is caught.

SUMMARY

In one aspect, the invention provides a method of training a user wearing an article of footwear, comprising the steps of: providing training instructions to the user; instructing the user to move along a predetermined path; instructing the user to kick a ball by contacting the ball with a ball control portion of the article of footwear, the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the plurality of protrusions are disposed in an arc-like configuration.

In another aspect, the invention provides a method of training a user wearing an article of footwear, comprising the steps of: providing training instructions to the user; instructing the user to dribble a ball around at least one marker; instructing the user to kick the ball with a ball control portion of the article of footwear, the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the plurality of protrusions are configured to bend in a manner so that the gripping portions confront a surface of the ball during the kick.

In another aspect, the invention provides a method of using an article of footwear, comprising the steps of: receiving training instructions; moving along a predetermined path, the predetermined path being determined from the training instructions; kicking a ball by contacting the ball with a ball control portion of the article of footwear, the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the major axes of some protrusions of the plurality of protrusions are aligned with a curve on a surface of a ball when the ball control portion contacts the ball during a kick.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
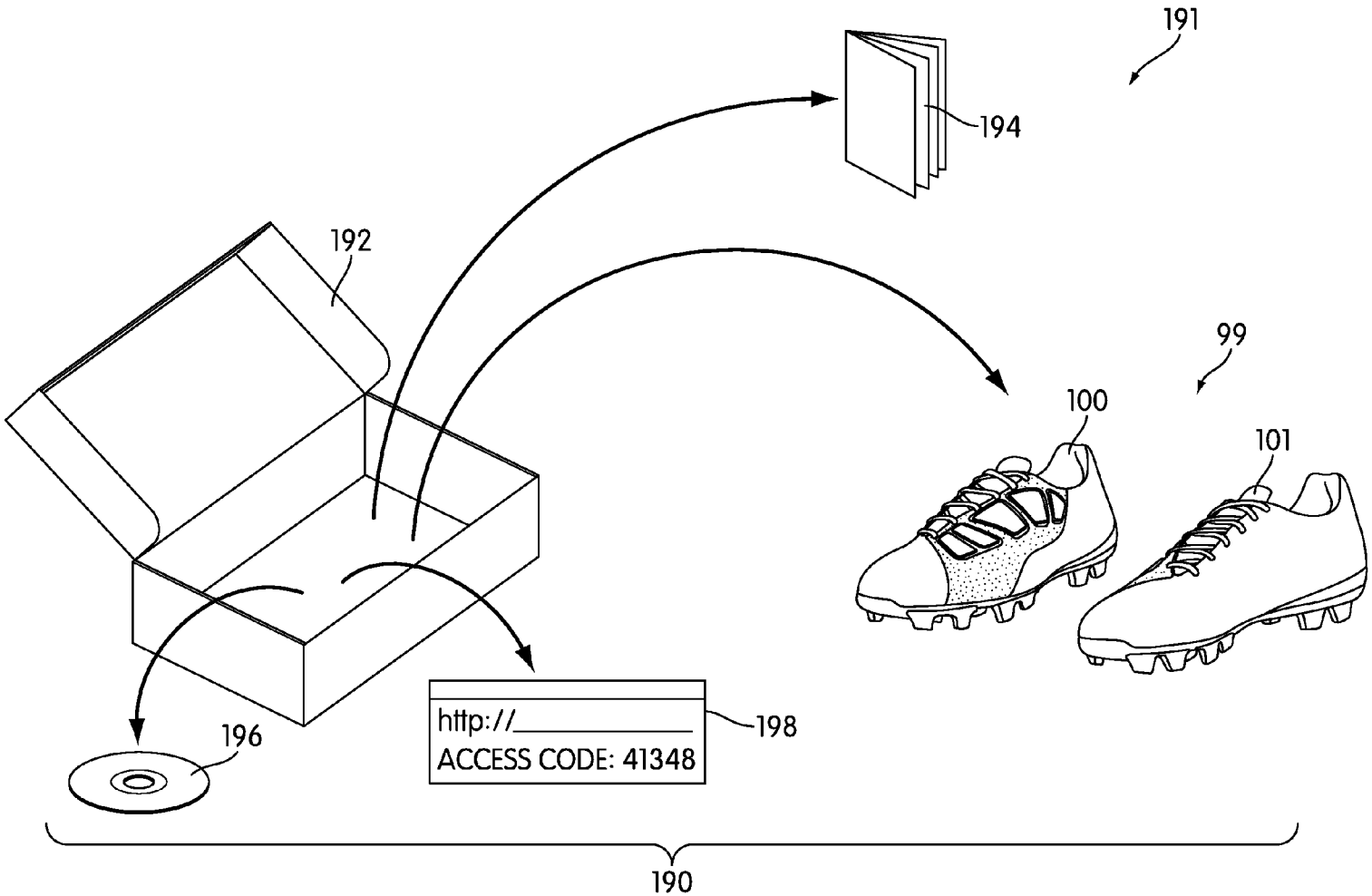
FIG. 1 is a schematic view of an embodiment of a training kit for use in training an athlete to use an article of footwear.

FIG. 1 illustrates an embodiment of training system 191. Training system 191 can be used with any type of footwear. In addition, the principles discussed throughout this detailed description may not be limited in use to footwear. Similar principles could be applied to customization kits for various different types of apparel as well. In an exemplary embodiment, training system 191 may provide a total training solution for an athlete. This total training solution may comprise a combination of footwear and training instructions that is designed to enhance specific athletic skills.

In some embodiments, some components of training system 191 may take the form of training kit 190, also referred to hereafter as kit 190. Kit 190 may comprise one or more items that are packaged together, or otherwise sold or purchased together. It will be understood that in other embodiments, however, components of training system 191 may not be packaged together as a kit but may be sold and/or purchased separately.

In some embodiments, training kit 190 may be used by a customer at home. For example, in some cases, a customer could purchase training kit 190 at a retail location and bring kit 190 home. In other cases, kit 190 may be shipped to an address associated with the customer. In other embodiments, kit 190 could be used at any other location, such as a retail store or a kiosk.

Kit 190 may include container 192. Container 192 can be any type of container configured to store at least one article of footwear. In some cases, container 192 may be a box. In an exemplary embodiment, container 192 may be a shoebox that is configured to store a pair of footwear.

In one embodiment, kit 190 can include pair of footwear 99. Pair of footwear 99 may further comprise first article of footwear 100 and second article of footwear 101. Generally, articles of footwear associated with kit 190 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 190 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

First article of footwear 100 and second article of footwear 101 may be oriented for a right foot and a left foot, respectively. For purposes of clarity, the following detailed description discusses first article of footwear 100, but it will be understood that each of the features discussed for first article of footwear 100 could also apply to second article of footwear 101. For purposes of convenience, first article of footwear 100 may also be referred to as article 100 throughout the remainder of this detailed description.

Kit 190 can also include provisions for training an athlete to use first article of footwear 100 and second article of footwear 101. The term "athlete" is intended to include both professional athletes and amateur athletes. Generally, an athlete may be any person wishing to take part in an athletic training activity. Any user of pair of footwear 99 may be referred to as an "athlete" throughout this detailed description and in the claims. Furthermore, the terms "athlete" and "user" may be used interchangeably throughout the detailed description and in the claims.

In some embodiments, kit 190 can include provisions for training an athlete to use an article of footwear to accomplish various skills that are important in one or more sports, such as football, soccer, tennis, or any other sport or activity. For example, in embodiments where kit 190 includes a pair of soccer shoes, kit 190 may further include training instructions that may train an athlete to use the pair of soccer shoes to kick, pass, dribble, trap, or perform other maneuvers or skills with a ball. Furthermore, in an exemplary embodiment, kit 190 can include training instructions that may be used by an athlete to learn to use specific features of one or more articles of footwear for accomplishing various skills such as kicking, passing, dribbling, running or making lateral cuts, as well as any other kinds of skills.

In the current embodiment, kit 190 may include one or more sets of training instructions. The term "training instructions" as used throughout this detailed description and in the claims refers to any instructions that can be used to train an athlete or user. Training instructions can be provided as written instructions, pictures, videos, audible instructions as well as any combination thereof.

In different embodiments, training instructions could be provided in different formats. In some cases, training instructions could be provided as paper based or printed instructions. In other cases, training instructions could be provided on various types of removable media. The term "removable media" refers to any media that can be inserted into a media reading device such as a computer, optical media player (including DVD players, CD players and Blu-ray players) or any other type of media reading device. Examples of removable media include, but are not limited to: computer disks, CDs, CD-ROMs, DVDs, Blu-rays discs, HD-DVD discs, removable hard drives, digital memory cards and flash drives as well as any other types of media that can be used with a media reading device.

In the current embodiment, kit 190 may include instruction booklet 194. Instruction booklet 194 may be a set of printed instructions that is packaged with pair of footwear 99 in container 192. In addition, kit 190 may include digital based instructions in the form of removable media 196. Removable media 196 may be inserted into a media reading device, including a computer or dedicated media player, for purposes of accessing training instructions. In an exemplary embodiment, removable media 196 may take the form of a DVD or CD-ROM. In other embodiments, kit 190 could be provided with information for accessing training instructions remotely. For example, in the current embodiment, kit 190 may include card 198. In some cases, card 198 may provide information for remotely accessing one or more sets of training instructions on the web. In particular, in one embodiment, card 198 may include an address for a website as well as any necessary access information such as a user ID and/or user password. In still other embodiments, card 198 could provide a user with information for obtaining one or more software programs that may include training instructions. For example, in one embodiment, card 198 could include information for downloading a software based training application on a computer or mobile device.

It will be understood that some of the provisions included in kit 190 are optional. In particular, in some cases a kit may only include one form of training instructions. Furthermore, in other embodiments training instructions can be provided in any other format.

Figure 2:
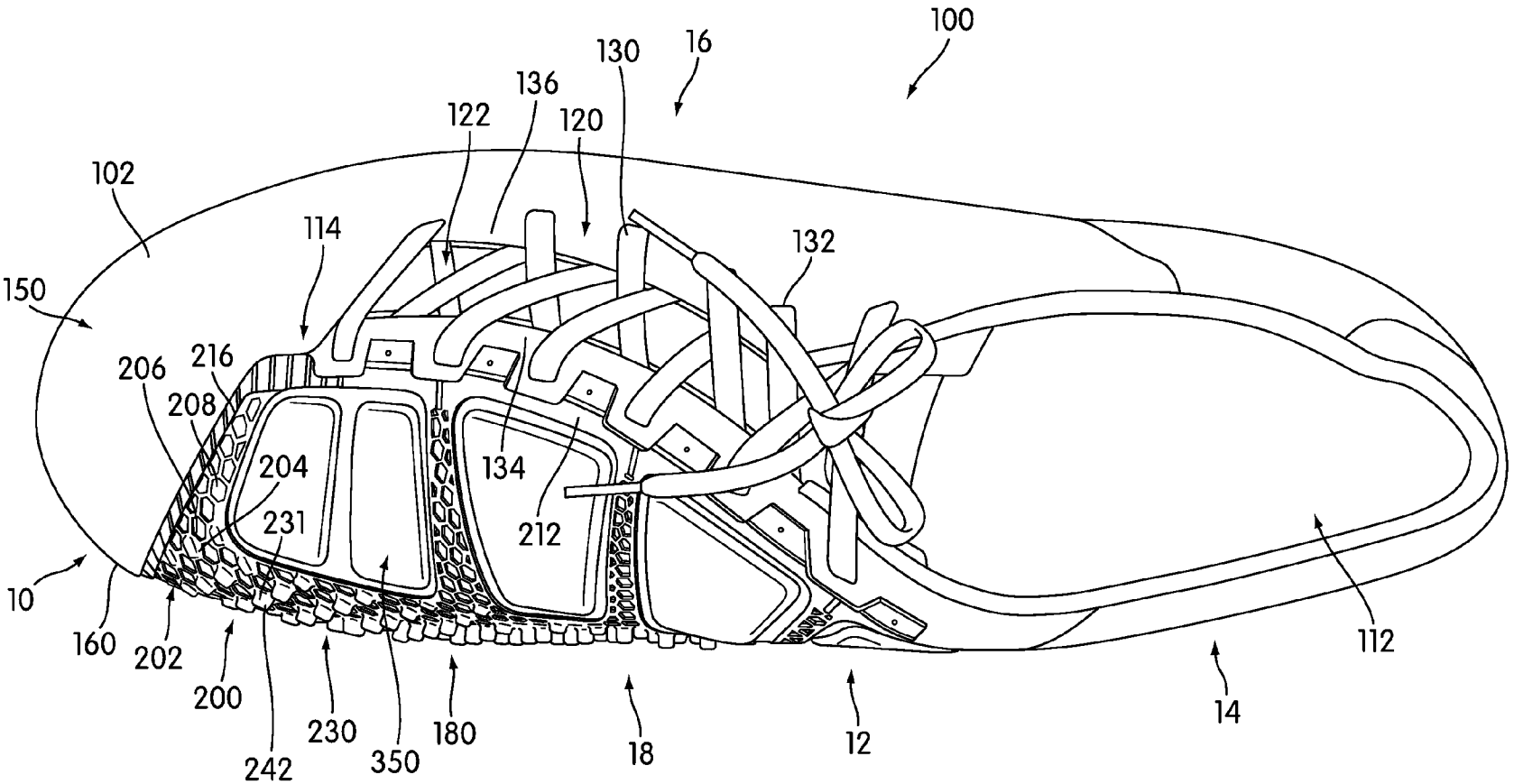
FIG. 2 is a top down view of an embodiment of an article of footwear associated with a training kit.
Figure 3:
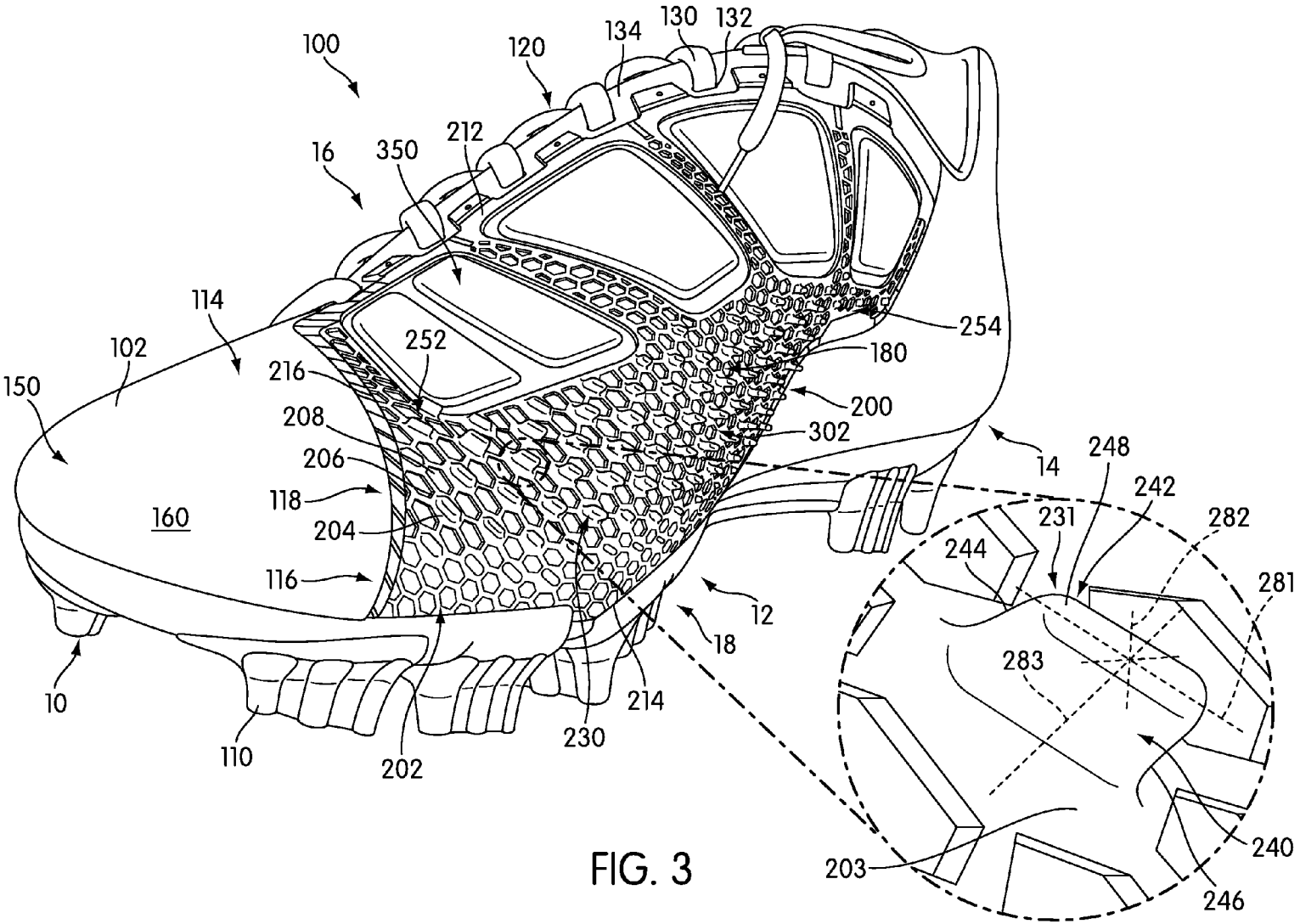
FIG. 3 is an isometric view of an embodiment of an article of footwear associated with a training kit.

FIG. 2 illustrates a top down view of an embodiment of first article of footwear 100, hereby also referred to as article 100. FIG. 3 illustrates an isometric view of an embodiment of article of footwear 100. Referring to FIGS. 2 and 3, for purposes of reference, article 100 may be divided into forefoot portion 10, midfoot portion 12 and heel portion 14.

Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole.

Article 100 can include an upper 102 and sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Upper 102 can include various portions. In one embodiment, upper 102 can include vamp portion 114. In addition, upper 102 can include lower portion 116 that is disposed adjacent to sole structure 110. Also, upper 102 can include sidewall portion 118 that is disposed between vamp portion 114 and lower portion 116.

Article 100 can include lacing system 120. In some cases, lacing system 120 can include medial lacing edge 134 and lateral lacing edge 136 that are separated by lacing gap 122. In particular, lacing gap 122 may extend from throat 112 of upper 102 towards forefoot portion 10. In addition, lacing gap 122 may be associated with lacing holes 132 that are disposed on medial lacing edge 134 and lateral lacing edge 136. Furthermore, lacing gap 122 may be further associated with lace 130 that may be disposed through lacing holes 132. With this arrangement, lace 130 may be used to tighten upper 102 around a foot.

In different embodiments, the shape of lacing gap 122 can vary. In some cases, lacing gap 122 may have a substantially straight shape. In other cases, lacing gap 122 may have a curved shape. In one embodiment, lacing gap 122 may be shaped to curve towards lateral side 16 from throat 112. In other words, lacing gap 122 may be arranged in an asymmetric manner on upper 102.

An article of footwear can include provisions for enhancing traction of an upper for purposes of better ball control during kicks. In some cases, an upper can include portions comprising a material that has a high coefficient of friction to provide better grip on a ball during kicks. In other cases, an upper can include structural features on an upper to help enhance friction. For example, in some cases, an upper can include structural features that are intended to increase surface area at a point of contact of the ball which can help enhance traction between the upper and the ball.

In one embodiment, upper 102 can include ball control portion 200. In this embodiment, ball control portion 200 may extend through portions of medial side 18 of upper 102. For example, in the current embodiment ball control portion 200 may extend from medial lacing edge 134 to sole structure 110 in a generally lateral direction. In some cases, ball control portion 200 may extend from forefoot portion 10 to heel portion 14 in a generally longitudinal direction. In particular, front edge 216 of ball control portion 200 may be disposed adjacent to toe portion 150 of upper 102. In addition, in some cases, first lateral edge 212 of ball control portion 200 may be disposed adjacent to medial lacing edge 134. Also, second lateral edge 214 may be disposed adjacent to sole structure 110 at forefoot portion 10. Furthermore, second lateral edge 214 may rise away from sole structure 110 at midfoot portion 10 and at heel portion 14.

In some embodiments, ball control portion 200 can include base portion 202. Generally, base portion 202 may be a layer of material that is applied to upper 102. In some cases, base portion 202 may comprise a contoured layer that generally conforms to the contours of medial side 18 of upper 102. In other cases, base portion 202 may be an initially flat layer that is stretched or otherwise wrapped over the contoured surface of upper 102.

In different embodiments, the structure of base portion 202 can vary. In some cases, base portion 202 may comprise a substantially uniform layer. In other cases, base portion 202 may comprise a non-uniform layer. In the current embodiment, base portion 202 may comprise a substantially webbed layer including connecting members that are spaced apart by gaps.

In one embodiment, base portion 202 may comprise hub portions 204. Hub portions 204 can be connected to one another by connecting members 206. Furthermore, hub portions 204 and connecting members 206 may be spaced apart by gaps 208. This arrangement may provide a web-like configuration for base portion 202. In other embodiments, however, base portion 202 could comprise a substantially solid layer without gaps.

In different embodiments, hub portions 204 can have varying shapes. In some cases, hub portions 204 may have substantially similar shapes to one another. In other cases, different hub portions of hub portions 204 can have substantially different shapes. In the current embodiment, hub portions 204 may all be configured with substantially hexagonal shapes. In other embodiments, however, hub portions 204 could be associated with any other types of shapes including, but not limited to: rounded shapes (such as circular or oval shapes), polygonal shapes (such as triangular, rectangular, pentagonal, etc.), regular shapes, irregular shapes, or any other types of shapes.

In different embodiments, gaps 208 could have varying shapes. In some cases, gaps 208 may have substantially similar shapes to one another. In other cases, different gaps of gaps 208 can have substantially different shapes. Furthermore, in some cases, gaps 208 may have shapes that correspond to the shapes of hub portions 204. In other cases, however, gaps 208 may have different shapes from hub portions 204. In the current embodiment, gaps 208 may have substantially hexagonal shapes that correspond to the shapes of hub portions 204. In other embodiments, however, gaps 208 could have any other shapes including any of the shapes discussed above.

Using the arrangement discussed above, the structural properties of base portion 202 can be varied. For example, by varying the size, shape and number of gaps in base portion 202, the rigidity of base portion 202 can be varied. In addition, by increasing the number of gaps, and thus decreasing the material comprising base portion 202, the overall weight of base portion 202 can be reduced to help minimize additional weight on upper 102.

A ball control portion can include provisions for increasing grip between an upper and a ball. In one embodiment, ball control portion 200 can include plurality of protrusions 230. Generally, plurality of protrusions 230 can be any type of protrusions that extend outwards from outer surface 160 of upper 102. In different embodiments, plurality of protrusions 230 can be configured in various ways. For example, in some cases, plurality of protrusions 230 may be characterized as fin-like protrusions. In other cases, plurality of protrusions 230 may be characterized as flap-like protrusions. In this embodiment, plurality of protrusions 230 may be characterized as fin-like protrusions.

In different embodiments, plurality of protrusions 230 can be associated with different portions of base portion 202. In some cases, plurality of protrusions 230 can be disposed on connecting members 206. In other cases, plurality of protrusions 230 can be disposed on hub portions 204. In an exemplary embodiment, plurality of protrusions 230 can be disposed on hub portions 204. For example, plurality of protrusions 230 may include first protrusion 231 that is disposed on first hub portion 293.

For purposes of characterizing the size, geometry and/or orientation of a protrusion, each protrusion discussed in this detailed description and in the claims may be associated with a set of axes that are defined relative to each protrusion. The term "major axis" as used throughout this detailed description and in the claims refers to an axis extending through a length of a protrusion. The term "minor axis" as used throughout this detailed description and in the claims refers to an axis extending through a width of a protrusion. Furthermore, the term "normal axis" as used throughout this detailed description and in the claims refers to a direction extending through a height of the protrusion, which is generally perpendicular (or normal) to a plane formed between the major axis and the minor axis. It should be understood that these axes are defined locally with respect to an individual protrusion so that a major axis of one protrusion may not be coincident with a major axis of another protrusion.

FIG. 3 includes an enlarged view of first protrusion 231 for purposes of illustrating the geometry of plurality of protrusions 230. Referring to FIG. 3, for purposes of description, first protrusion 231 may be associated with major axis 281, minor axis 282 and normal axis 283 in the manner described above. In some cases, first protrusion 231 includes first gripping portion 240 and second gripping portion 242 (see FIG. 2), which is disposed opposite of first gripping portion 240. First gripping portion 240 and second gripping portion 242 may form sidewalls for first protrusion 231. In particular, first gripping portion 240 and second gripping portion 242 are approximately planar surfaces that extend along major axis 281 and normal axis 283 of first protrusion 231. In other embodiments, however, first gripping portion 240 and second gripping portion 242 can be substantially curved surfaces.

First protrusion 231 can also include first side edge 244 and second side edge 246 that extend along minor axis 282 between first gripping portion 240 and second gripping portion 242. In some cases, first side edge 244 and second side edge 246 can be approximately planar edges. In other cases, however, first side edge 244 and second side edge 246 can be approximately rounded edges. In addition, first protrusion 231 can include top surface 248 that extends along major axis 281 and minor axis 282 at an outward most end of first protrusion 231. In some cases, top surface 248 may be an approximately planar top surface that presents a flat end for first protrusion 231. In other cases, however, top surface 248 may be a rounded surface.

In different embodiments, the dimensions of first protrusion 231 can vary. In an exemplary embodiment, the length of first protrusion 231, which is associated with major axis 281, may be substantially larger than the width, which is associated with minor axis 282. Likewise, the height of first protrusion 231, which is associated with normal axis 283, may be substantially larger than the width. Still further, the length may be substantially larger than the height. With this arrangement for the dimensions of first protrusion 231, first gripping portion 240 and second gripping portion 242 may comprise a majority of the surface area of first protrusion 231.

In some embodiments, first protrusion 231 may be configured to bend. In some cases, first protrusion 231 may be configured to bend about an axis approximately parallel to major axis 281. In other words, first protrusion 231 may be configured to bend in a manner that disposes either first gripping portion 240 or second gripping portion 242 closer to outer surface 160 of upper 102. For example, in one direction of bending, second gripping portion 242 may approximately confront base portion 202. Furthermore, in this case, first gripping portion 240 may be oriented to face outwardly and away from upper 102. In addition, in a second direction of bending, first gripping portion 240 may approximately confront base portion 202. Furthermore, in this case, second gripping portion 242 may be oriented to face outwardly and away from upper 102. With this arrangement, as first protrusion 231 bends, either first gripping portion 240 or second gripping portion 242 are exposed outwardly on outer surface 160 of upper 102. This arrangement can increase the surface area of first protrusion 231 that is exposed outwardly on upper 102, which can help increase grip on a ball during kicks, for example.

It will be understood that the discussion above for first protrusion 231 may be applied to any protrusion of plurality of protrusions 230. In other words, the general geometry of each protrusion of plurality of protrusions 230 may be substantially similar to the geometry described for first protrusion 231. In addition, each protrusion of plurality of protrusions 230 may be provided with at least one gripping portion that is configured to contact a ball. Furthermore, each protrusion can be configured to bend in a similar manner about a major axis of the protrusion so as to expose a gripping portion outwardly on upper 102.

A ball control portion including protrusions can include provisions for improving contact with a ball during kicks. In some embodiments, protrusions can be selectively applied to regions of an upper that impact a ball during various types of kicks. In one embodiment, protrusions can be selectively applied to a predetermined kicking region of an upper. The term "predetermined kicking region" as used throughout this detailed description and in the claims refers to a region of an article that is configured to impact a ball during a predetermined type of kick. For example, in a free kick situation in soccer, a player may want to put sidespin on the ball in order to curve the trajectory of the ball. This type of kick is often referred to as a "banana kick," and is useful for kicking the ball at a target that is on the other side of an obstruction, such as an opposing player. In order to apply sidespin to the ball, the play may kick the ball off center using the medial side, or instep of the upper. Therefore, in some embodiments, a ball control portion can include protrusions that are disposed on the instep of the upper to facilitate a kick in which sidespin is applied to the ball.

Referring to FIGS. 2 and 3, in the current embodiment, plurality of protrusions 230 may arranged on predetermined kicking region 180 of upper 102. In this case, predetermined kicking region 180 may be disposed on medial side 18 of sidewall portion 118 of upper 102. Furthermore, predetermined kicking region 180 may extend from toe portion 150 to midfoot portion 12 of upper 102. In the current embodiment, predetermined kicking region 180 may include the instep of upper 102 as well as adjacent areas to the instep. With this arrangement, plurality of protrusions 230 may be disposed on portions of upper 102 that are most likely to contact a ball during a medial side kick.

Protrusions of a ball control portion can be oriented in a manner that increases the contact area between the protrusions and a rounded surface such as a ball. In some embodiments, protrusions can be arranged in a curved configuration that corresponds to the natural curvature of a ball surface, which is approximately spherical. In one embodiment, plurality of protrusions 230 can be aligned in an arc-like configuration. The term "arc" as used throughout this detailed description and in the claims refers to any segment of a curve. In some cases, an arc could be a segment of a circle. In other cases, however, an arc could be a segment of any other type of curve.

In one embodiment, plurality of protrusions 230 can be arranged in arc-like configuration 302. In particular, first group of protrusions 252 of plurality of protrusions 230, which are disposed in forefoot portion 10, may be oriented in a first direction. Also, second group of protrusions 254 of plurality of protrusions 230, which are disposed in midfoot portion 12, may be oriented in a second direction. In other words, the major axis of each protrusion associated with first group of protrusions 252 may be oriented approximately in a first direction. Likewise, the major axis of each protrusion associated with second group of protrusions 254 may be oriented approximately in a second direction. It will be understood that the first direction and the second direction are only intended to indicate average directions. In particular, although the major axis of each protrusion of first group of protrusions 252 may be oriented in slightly different directions from one another, the first direction may characterize the overall direction, or average direction, of the protrusions of first group of protrusions 252. Similarly, although the major axis of each protrusion of second group of protrusions 254 may be oriented in slightly different directions from one another, the second direction may characterize the overall direction, or average direction, of the protrusions of second group of protrusions 254. Still further, the protrusions disposed between first group of protrusions 252 and second group of protrusions 254 may be oriented in a manner that continuously varies between the first direction and the second direction.

In some cases, the first direction may be substantially similar to the second direction. In other cases, however, the first direction may be a substantially different direction than the second direction. For example, in one embodiment, the first direction may be a direction oriented close to a lateral direction, while the second direction may be a direction oriented close to a longitudinal direction.

In some embodiments, arc-like configuration 302 may have a configuration that corresponds to the curvature of a generally spherical ball. For example, in one embodiment, arc-like configuration 302 may correspond to the curvature of a soccer ball. In particular, the shape and size of arc-like configuration 302 may be selected so that as a ball contacts predetermined kicking region 180, plurality of protrusions 230 may be substantially tangent to an outer surface of the ball. It will be understood that in other embodiments, arc-like configuration 302 can correspond to the shapes of different shapes and/or sizes of balls. For example, in another embodiment, arc-like configuration 302 could have a size and shape that correspond to the curvature of a football that is used in American football. In still another embodiment, arc-like configuration 302 can have a size and shape that corresponds to the curvature of a ball that is used in rugby.

In will be understood that arc-like configuration 302 is only intended to approximate the configuration of plurality of protrusions 230. In some cases, plurality of protrusions 230 may be associated with individual arcs that extend over a portion of ball control portion 200. For example, in one embodiment, plurality of protrusions 230 may be arranged on adjacent arcs that extend from vamp portion 114 and lower portion 116 of upper 102.

Article 100 may be made from materials known in the art for making articles of footwear. For example, sole structure 110 may be made from any suitable material, including, but not limited to: elastomers, siloxanes, natural rubber, other synthetic rubbers, aluminum, steel, natural leather, synthetic leather, or plastics. Also, an upper may be made from any suitable material, including, but not limited to: nylon, natural leather, synthetic leather, natural rubber or synthetic rubber.

In different embodiments, the materials used for a ball control portion including a plurality of protrusions can vary. In some embodiments, a base portion of a ball control portion and a plurality of protrusions disposed on the base portion can be made of a substantially similar material. For example, in one embodiment, a base portion and a plurality of protrusions, can be made of a substantially monolithic molded material. Examples of materials for making a ball control portion include, but are not limited to: elastomers, siloxanes, natural rubber, other synthetic rubbers as well as any other materials. In some cases, materials with relatively high coefficients of friction can be used to increase grip on a ball. In other embodiments, however, a plurality of protrusions could be made of a substantially different material than a base portion. For example, in another embodiment, a base portion of a ball control portion can be made of a material with a lower coefficient of friction than a material used for a plurality of protrusions.

Some embodiments can include additional provisions for enhancing accuracy during a kick. In some cases, article of footwear 100 can include one or more instep-pods. For example, in the current embodiment, article 100 includes plurality of instep-pods 350. In this case, plurality of instep-pods 350 includes five instep-pods that are disposed on medial side 18 of article 100. In some cases, instep-pods 350 can facilitate shape correction. In particular, in some cases, instep-pods 350 may be shape correcting members or pads that provide even pressure over one or more bony regions of a foot to create a more accurate shot. In some embodiments, instep-pods 350 may help create consistent contact with a ball during a full instep shot. Examples of articles with shape correcting members are disclosed in Baker et al., U.S. patent application Ser. No. 12/473,618, now U.S. Pat. No. 8,196,321, filed on May 28, 2009, the entirety of which is hereby incorporated by reference and referred to throughout the remainder of this detailed description as the "Baker case". Moreover, in some cases, the combination of instep-pods and protrusions of a ball control portion can help improve accuracy for various different kinds of kicks. For example, instep-pods may facilitate more accurate kicking when a ball is kicked using an upper instep surface of an article, while protrusions may facilitate more accurate kicking when a ball is kicked using a medial instep surface of an article.

Further details about an article of footwear with a ball control portion may be found in Atsumi et al., U.S. Pat. No. 8,196,322, (currently U.S. application Ser. No. 12/474,852), referenced above.

Figure 4:
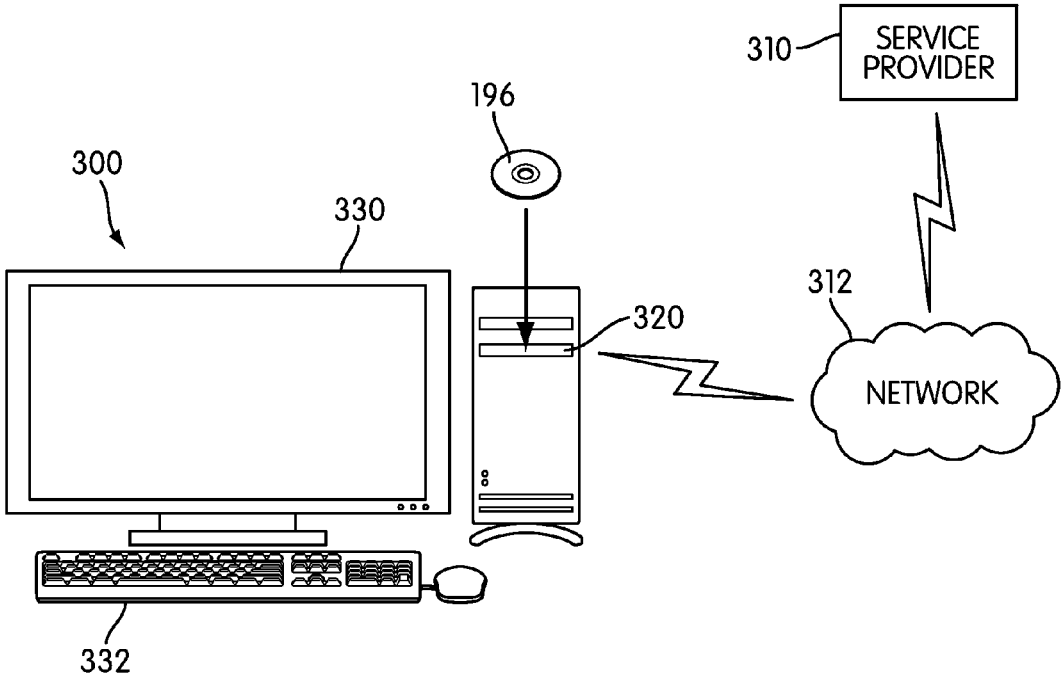
FIG. 4 a schematic view of an embodiment of a computing device that may be used for viewing a set of training instructions.

FIG. 4 illustrates a schematic view of an embodiment of computing device 300. Computing device 300 may be any type of computer, including either a desktop or a laptop computer. In other embodiments, computing device 300 may be any type of device that includes a display and a processor. In some cases, computing device 300 may also include provisions for transmitting and receiving information from a remote network. Examples of such devices include, but are not limited to: PDA's, cell phones, as well as other types of devices.

Computing device 300 can include display device 330 for viewing training instructions. In some cases, computing device 300 can also include input devices 332. In this case, input devices 332 may comprise a keyboard and a mouse.

Computing device 300 may be used to access training instructions stored on electronic media of some kind. For example, in the current embodiment, computing device 300 could be used to access training instructions that may be stored in removable media 196. In this case, computing device 300 may include media drive 320. In addition, computing device 300 may be used to access training instructions that may be stored on other types of media including memory cards, flash drives, as well as any other electronic media device that is capable of being read by a computing device.

In some embodiments, training instructions may be stored at service provider 310. Service provider 310 may be any remote system capable of storing training instructions. In some cases, service provider 310 could comprise one or more servers. In addition, in some cases, training instructions could be stored in the form of content for a website that is hosted by, or in association with, service provider 310. With this arrangement, a user could download training instructions from the website.

Computing device 300 may be configured to access service provider 310 using network 312. Generally, network 312 may be a system allowing for the exchange of information between computing device 300 and service provider 310. Examples of such networks include, but are not limited to: personal area networks, local area networks, wide area networks, client-server networks, peer-to-peer networks, as well as other types of networks. Additionally, the network may support wired transmissions, wireless transmissions, or both wired and wireless transmissions. In some embodiments, network 312 may be a packet-switched communications system. In an exemplary embodiment, network 312 may be the Internet.

Figure 5:
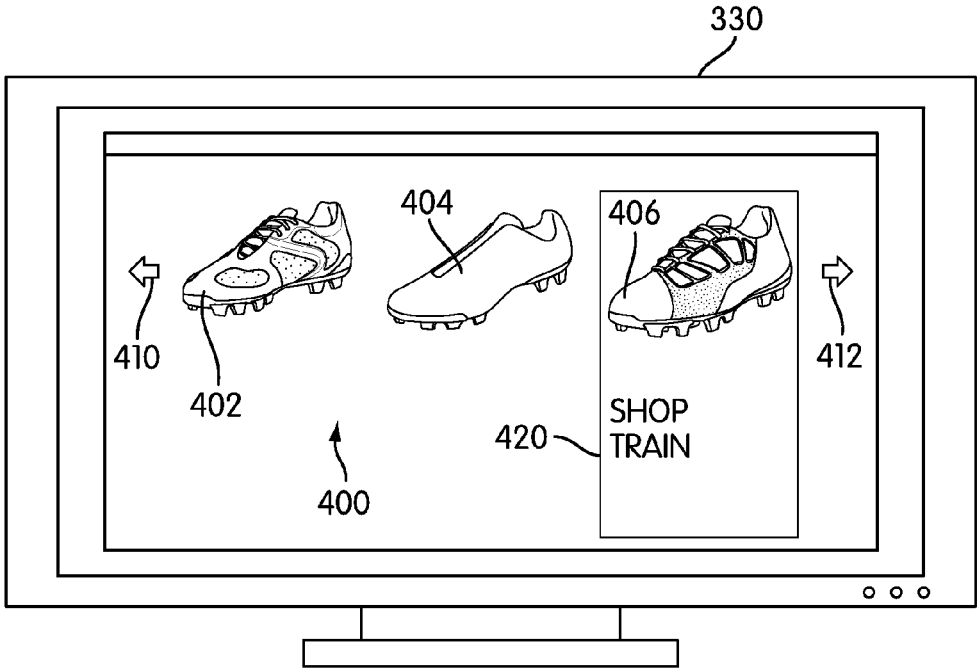
FIG. 5 is a schematic view of an embodiment of a website for viewing a set of training instructions.
Figure 6:
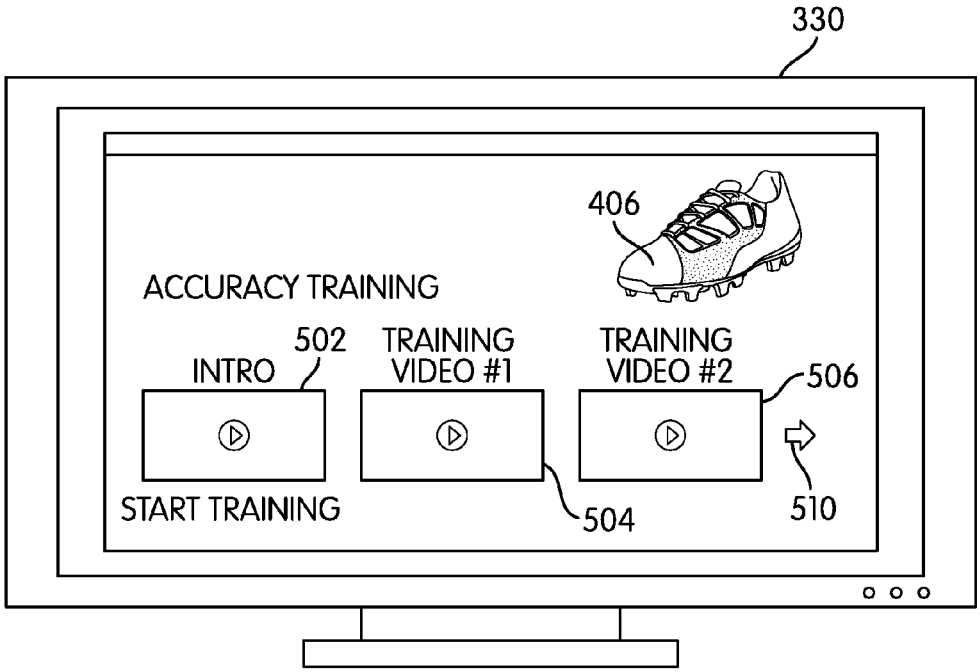
FIG. 6 is a schematic view of an embodiment of a website for viewing a set of training instructions.

FIGS. 5 and 6 illustrate schematic views of an embodiment of a website that provides access to one or more sets of training instructions. It will be understood that the current embodiment is only intended to be exemplary. In other embodiments, a web site configured to provide access to one or more sets of training instructions could have any other layout and/or design. Furthermore, in other embodiments, a user could access training instructions through any other type of interface including various types of software interfaces.

Referring to FIG. 5, in some cases, upon visiting a website a user may be prompted to select a particular article of footwear. In the current embodiment, a user has the option of selecting one of three different types of footwear from footwear menu 400. In particular, a user can choose from first article 402, second article 404 and third article 406. In some cases, first article 402, second article 404 and third article 406 may comprise substantially different kinds of footwear. In other cases, first article 402, second article 404 and third article 406 may comprise similar kinds of footwear. In an exemplary embodiment, first article 402, second article 404 and third article 406 may each be articles with different features that help enhance the performance of a user in different skill areas. For example, in some cases, third article 406 could be an article of footwear that helps enhance kicking accuracy for a user. Third article 406 could be used with sports such as soccer. In other cases, third article 406 could be used with other sports that require a user to kick a ball accurately. In one embodiment, third article 406 could be substantially similar to first article of footwear 100 that is discussed above. In particular, third article 406 could include a ball control portion for improving the accuracy of a kick.

In addition, in some cases, first article 402 could be an article of footwear that helps enhance ball control during passing and other maneuvers. Furthermore, in some cases, second article 404 could be an article of footwear that helps enhance the speed of a user on a playing surface. Although three articles of footwear are illustrated in the current embodiment, other embodiments could include any other number of footwear. In some cases, a user may choose to view other footwear options by pressing on first menu cursor 410 or second menu cursor 412. This allows a user to scroll through various footwear options.

In some embodiments, each type of footwear that is associated with a predetermined skill set (control, accuracy and speed, for example) may be associated with a particular set of training instructions that are configured to train an athlete in developing the associated skill set. For example, a user could be provided with training instructions for developing ball control using articles of footwear with shape correcting members. Likewise, a user could be provided with training instructions for developing kicking accuracy using articles of footwear including features intended to enhance kicking accuracy. Still further, a user could be provided with training instructions for developing speed using articles of footwear intended to enhance the speed of a user.

In some cases, upon selecting an article of footwear from footwear menu 400, a user may be prompted with first drop down menu 420 that includes options to purchase the selected footwear or train using the selected footwear. To obtain access to one or more sets of training instructions, a user may select "train" from drop down menu 420. At this point, a user may be prompted with a set of training instructions in the form of training videos, as seen in FIG. 6. In this case, a user may be prompted to select introduction video 502, training video 504 or training video 506. In addition, a user may select additional training videos by clicking on menu cursor 510.

Generally, training videos could be organized in any manner. In some cases, training videos may be organized by content or type. In other cases training videos may be organized in terms of a timeline for a user to progress from one training video to another. For example, in some cases, training videos could be organized in terms of a weekly progression that has a user viewing different videos, or different combinations of videos, each week. In still other cases, training videos could be organized in any other manner.

Although the current embodiment uses sets of training instructions in the form of training videos, in other embodiments sets of training instructions could take any other format. For example, in other cases, a set of training instructions could be provided on a website as a set of written instructions with diagrams and/or pictures of some kind. In still other cases, a set of training instructions could be provided on a website as an audio file that can be listened to for audibly giving the user instructions. Moreover, in still other embodiments, a set of training instructions could be provided on a website in multiple different formats including videos, audio files, written instructions and/or pictures.

FIGS. 7 through 11 illustrate schematic views of an embodiment of a method of providing training instructions in the form of a training video. In particular, FIGS. 7 through 11 illustrate an embodiment of a training drill that may be used to teach an athlete to accurately kick a ball using an article of footwear including a ball control portion. It will be understood that the current embodiment is only intended to be exemplary of one type of drill that could be used to train an athlete. In other embodiments, other types of drills including training instructions could be used.

In the current embodiment, first athlete 702 and second athlete 704 may be provided with articles of footwear. In this case, second athlete 704 is wearing first article of footwear 100 and second article of footwear 101, each of which includes a ball control portion. In some cases, first athlete 702 may also be wearing substantially similar footwear.

Figure 7:
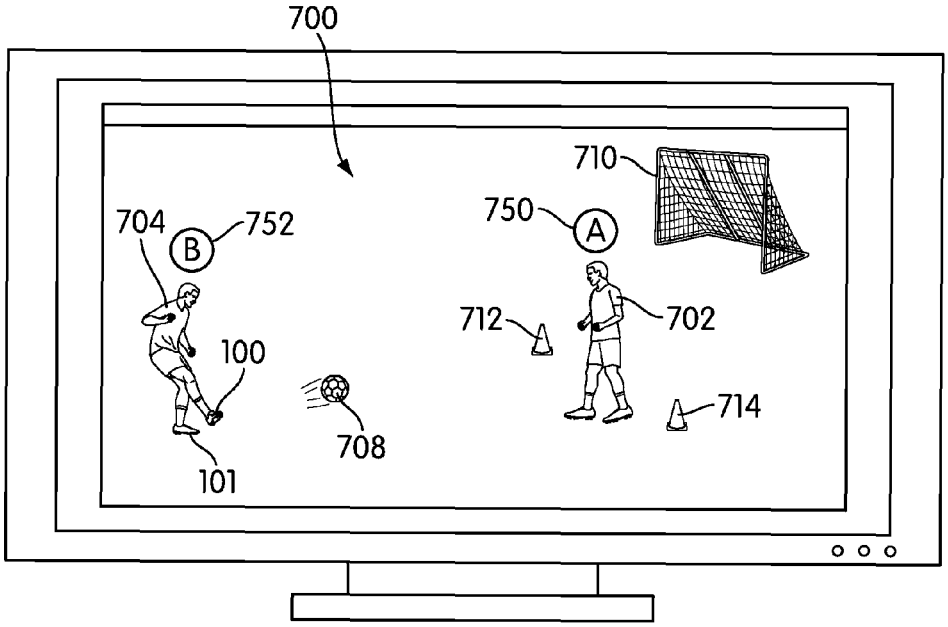
FIG. 7 is a schematic view of an embodiment of a training video for training an athlete to use an article of footwear with a ball control portion.

Referring to FIGS. 7 through 11, training video 700 may provide instructions for an accuracy drill that is intended to train a user to kick accurately using an article of footwear with a ball control portion. Referring to FIG. 7, first athlete 702 and second athlete 704 are positioned in front of goal 710. In some cases, first athlete 702 may be positioned midway between first marker 712 and second marker 714. In the current embodiment, first marker 712 and second marker 714 are cones, but in other embodiments any other kinds of markers could be used. First athlete 702 may be standing just outside of the penalty box. In other cases, however, first athlete 702 could be located in any other position on the field. In addition, second athlete 704 may be standing approximately 10 meters away from first athlete 702. In other cases, however, first athlete 702 and second athlete 704 could be separated by any other distance. Second athlete 704 may have possession of ball 708 before the drill begins.

In some embodiments, a training video can include various indicators. For example, in the current embodiment, training video 700 includes first indicator 750 for visually indicating the location of first athlete 702. Likewise, training video 700 includes second indicator 752 for visually indicating the location of second athlete 704. This arrangement may help provide clarity in identifying different athletes as the athletes move across a playing field. In other embodiments, any other indicators could be used for facilitating an explanation of the training instructions.

Figure 8:
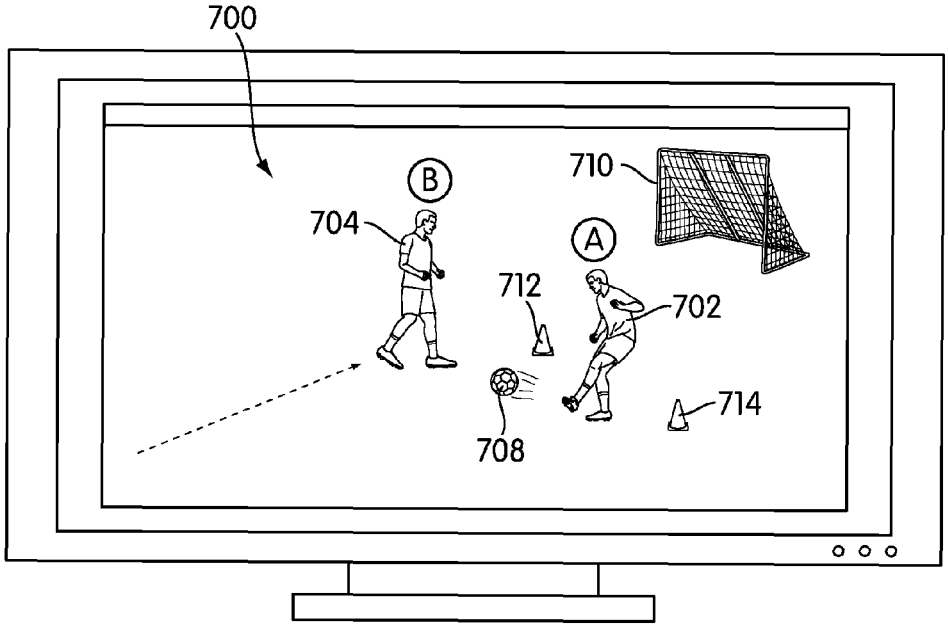
FIG. 8 is a schematic view of an embodiment of a training video for training an athlete to use an article of footwear with a ball control portion.

Initially, training video 700 may instruct second athlete 704 to pass ball 708 to first athlete 702. After passing ball 708, second athlete 704 may be instructed to run off to the side of first athlete 702. At this point, training video 700 instructs first athlete 702 to lay the ball off for second athlete 704, as seen in FIG. 8.

Figure 9:
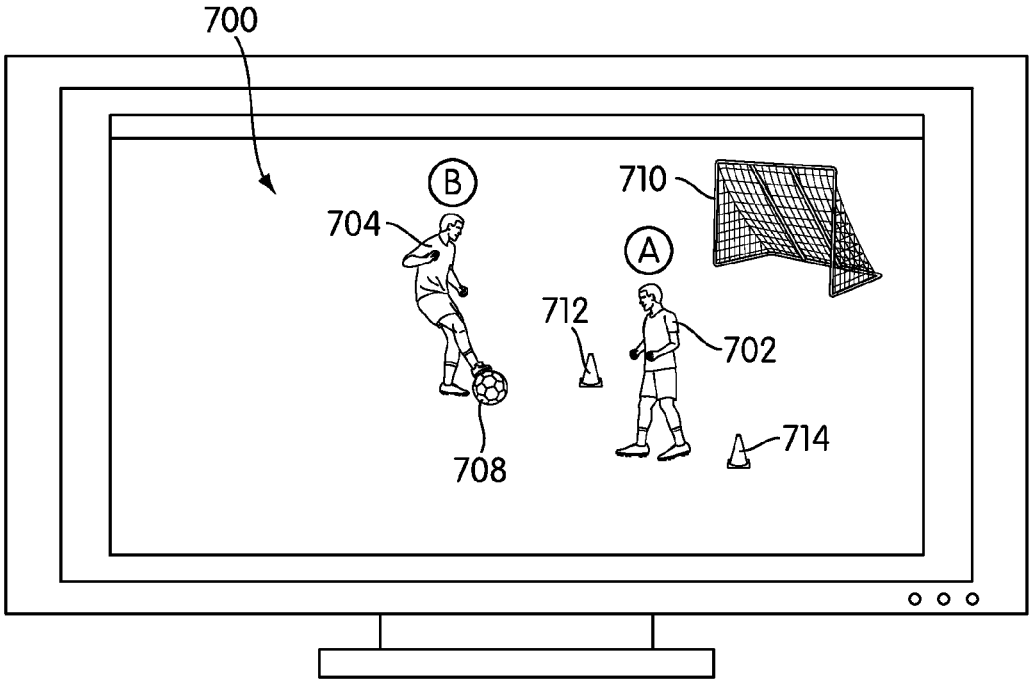
FIG. 9 is a schematic view of an embodiment of a training video for training an athlete to use an article of footwear with a ball control portion.

In FIG. 9, second athlete 704 is instructed to receive and control ball 708. In some cases, second athlete 704 may be instructed to trap ball 708. In other cases, second athlete 704 may be instructed to control ball 708 in another manner. Once second athlete 704 has controlled ball 708, second athlete 704 is instructed to take a shot at goal 710. In particular, second athlete 704 may be instructed to kick ball 708 so that ball control portion 200 (see FIGS. 2 and 3) contacts ball 708.

Figure 10:
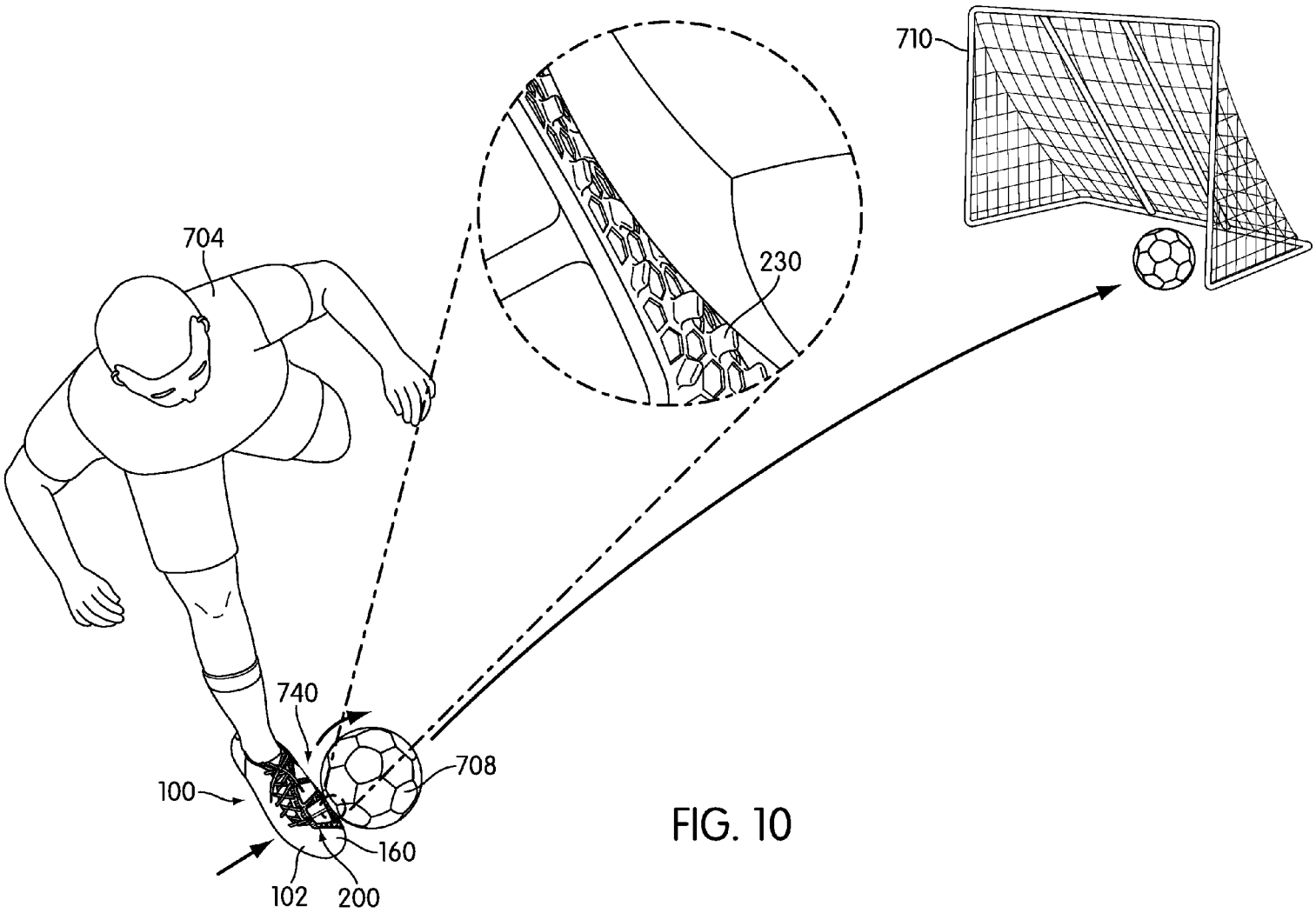
FIG. 10 is a schematic view of an embodiment of a training video for training an athlete to use an article of footwear with a ball control portion.
Figure 11:
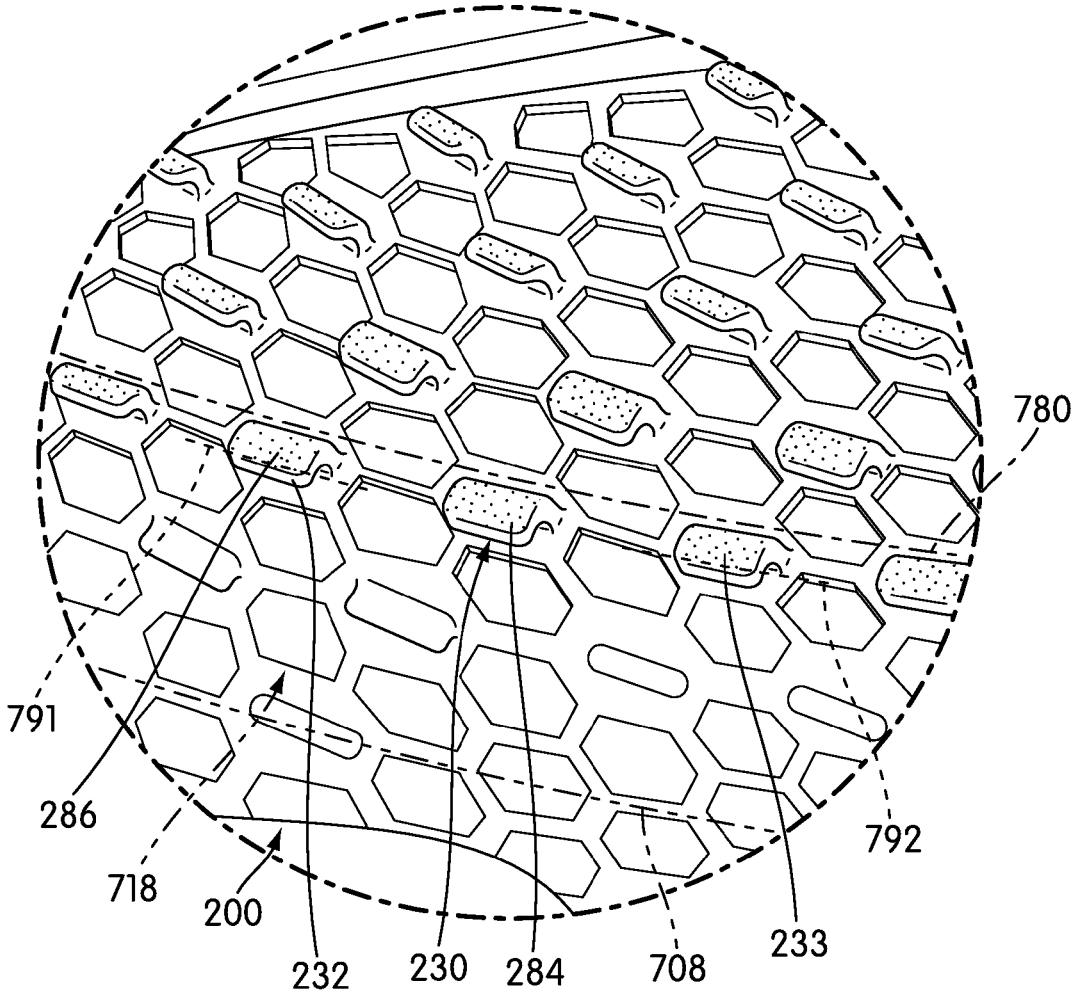
FIG. 11 is a schematic view of an embodiment of a training video for training an athlete to use an article of footwear with a ball control portion.

FIG. 10 illustrates a view of an embodiment of second athlete 704 kicking ball 708 by contacting ball 708 with ball control portion 200 of article 100. FIG. 11 illustrates a view of ball 708 contacting a portion of ball control portion 200 during a kick. Referring to FIGS. 10 and 11, a user may be instructed to contact ball 708 using instep portion 740 of upper 102. In particular, in some cases, a user may be instructed to apply instep portion 740 of upper 102 several centimeters from a center position of ball 708. At this point, plurality of protrusions 230 may contact ball 708.

In some cases, plurality of protrusions 230 may bend in a manner so that one or more gripping portions of protrusions 230 confront a surface of ball 708. For example, in the current embodiment, plurality of protrusions 230 may bend or deflect downwards in a manner that exposes first set of gripping portions 284 in an outward direction. Furthermore, second set of gripping portions 286 may be bent outwards towards outer surface 160 of upper 102.

Because first set of gripping portions 284 are directed outwardly from upper 102, first set of gripping portions 284 may confront ball surface 718 of ball 708. Furthermore, because of the flexibility of plurality of protrusions 230, first gripping portions 284 may conform to ball surface 718 in a manner that maximizes the surface contact area between first set of gripping portions 284 and ball surface 718. In contrast to situations where a ball may only contact a small region of an upper, the current embodiment provides flexible protrusions that bend in a manner to create a greater surface contact area between upper 102 and ball 708.

In addition, as illustrated in FIG. 11, the curved arrangement of plurality of protrusions 230 in the current embodiment may correspond to the curvature of ball 708. In particular, plurality of protrusions 230 may be aligned with curve 780 of ball surface 718. Specifically, some of plurality of protrusions 230 may be aligned so that the major axis of each protrusion is aligned with curve 780. In this embodiment, for example, first major axis 791 of second protrusion 232 may be generally oriented along curve 780. Likewise, second major axis 792 of third protrusion 233 may be generally oriented along curve 780. This configuration may help increase the total number of protrusions of plurality of protrusions 230 that are in contact with ball surface 718.

This arrangement facilitates increased grip between ball control portion 200 and ball 708, as athlete 704 continues the kicking motion. In particular, the vertical component of the kicking motion is applied to ball surface 718 due to the enhanced grip provided by ball control portion 200. This arrangement acts to add rotation, or sidespin, to ball 708 as ball 708 is kicked towards goal 710.

As mentioned, the current embodiment is only intended to be exemplary. In other embodiments, the training drill described here could be modified in any other manner. For example, in another embodiment an accuracy training drill may include instructions for three or more athletes. In another embodiment, an accuracy training drill could include instructions for a single athlete.

In addition to providing visual instructions, a training system may be configured to provide additional training information. For example, in some cases, a training system could provide information related to the number of repetitions of a drill that is shown in a training video. In an exemplary embodiment, an athlete may be provided with a worksheet that indicates the desired number of repetitions of a drill for a particular day of a training schedule.

Figure 12:
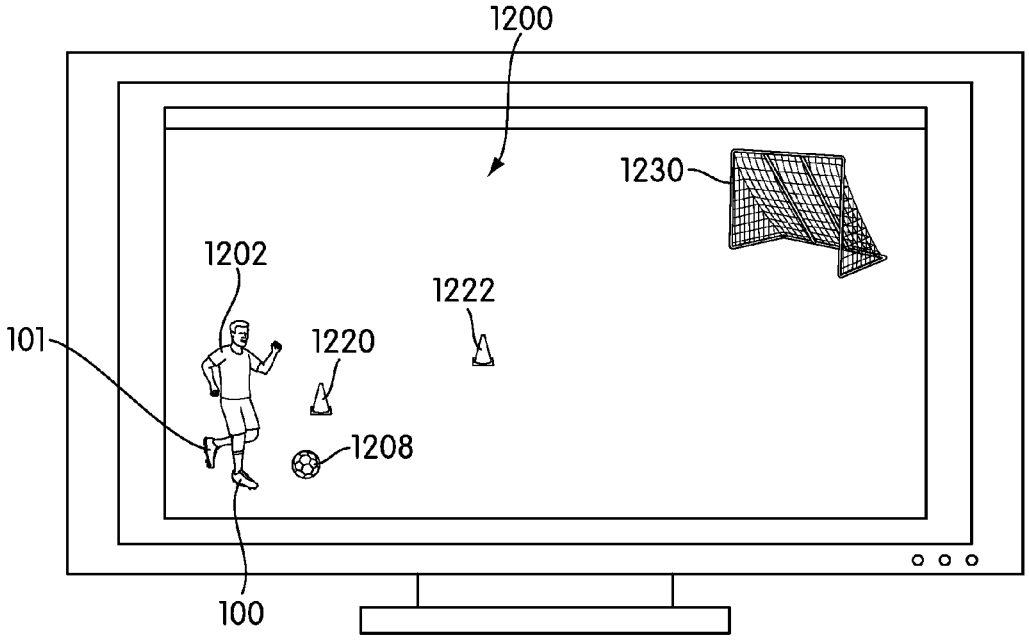
FIG. 12 is a schematic view of an embodiment of a training video for training an athlete to use an article of footwear with a ball control portion.
Figure 13:
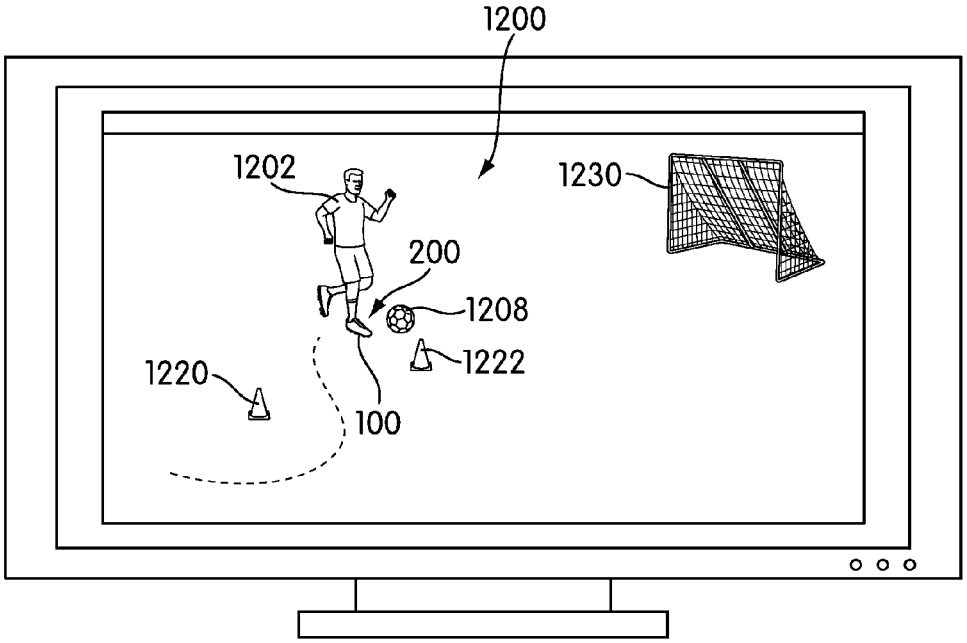
FIG. 13 is a schematic view of an embodiment of a training video for training an athlete to use an article of footwear with a ball control portion.
Figure 14:
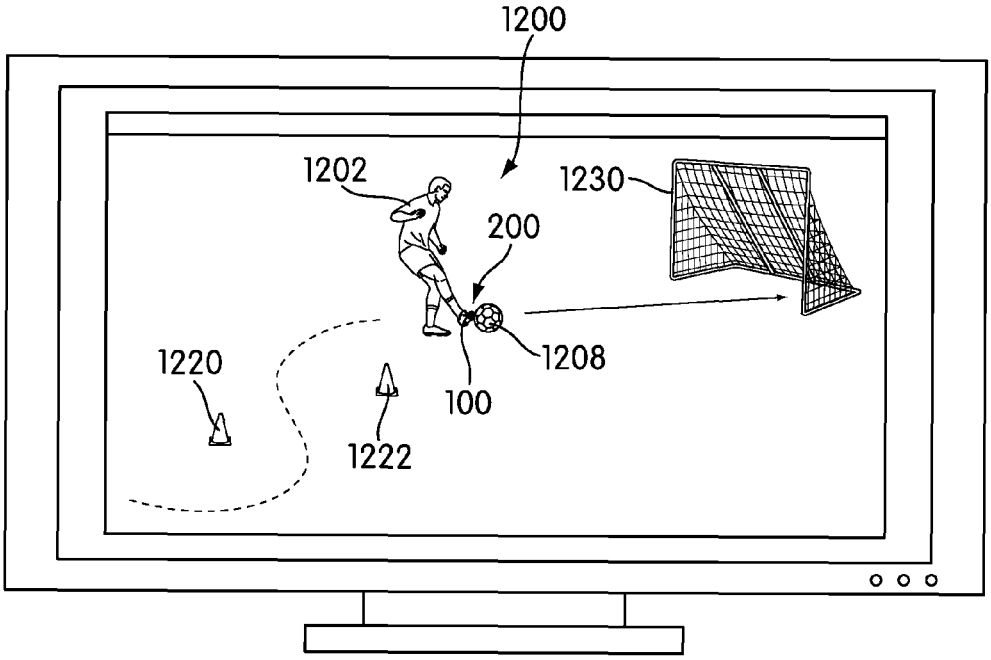
FIG. 14 is a schematic view of an embodiment of a training video for training an athlete to use an article of footwear with a ball control portion.

FIGS. 12 through 14 illustrate schematic views of another embodiment of a method of providing a set of training instructions to an athlete in the form of a training video. Referring to FIG. 12, training video 1200 shows athlete 1202 on a playing field. In the current embodiment, athlete 1202 is wearing first article of footwear 100 and second article of footwear 101, which each include ball control portions. Additionally, training video 1200 shows first marker 1220 and second marker 1222 as well as goal 1230.

In this embodiment, training video 1200 instructs athlete 1202 to dribble ball 1208 around first marker 1220 and second marker 1222, as seen in FIG. 13. As athlete 1202 dribbles around second marker 1222, athlete 1202 is instructed to kick ball 1208. In particular, athlete 1202 may be instructed to kick ball 1208 by contacting ball 1208 with ball control portion 200 (see FIGS. 2 and 3) of article 100, as seen in FIG. 14. As previously discussed, ball control portion 200 provides increased grip between ball 1208 and article 100 that allows for improved accuracy when kicking.

The previous embodiments are intended to be exemplary of the different types of training instructions that can be provided to athletes for the purposes of improving kicking accuracy using articles of footwear with ball control portions. In still other embodiments, other types of drills could be used and shown in training videos. Additional examples of training drills or exercises include, but are not limited to: stop and shoot drills, direct shot drills, direct shot with rotation drills, dribble and shoot drills, acrobatic drills, as well as other types of drills. Stop and shoot drills can include any drills in which a ball is passed between two or more athletes and one of the athletes receives a final pass, stops to control the ball and finally takes a shot at a target area. Direct shot drills can include any drills in which one athlete lays a ball off for another athlete who takes a shot at a target area without stopping to control the ball. Dribble and shoot drills can include any drills in which an athlete dribbles around one or more markers (such as cones) and shoots into a target area. Athletic drills can include any drills in which an athlete runs or spins onto a ball and volleys the ball into a target area. Moreover, each of these different types of training drills or training videos may incorporate training instructions that are intended to teach an athlete to perform controlled kicks using an article of footwear with a ball control portion.

In some embodiments, a training system may be implemented using a mobile device. In some cases, training instructions can be provided on a web browser operating on the mobile device. In other cases, training instructions can be provided using one or more applications that are configured to run on the mobile device. In still other cases, training instructions can be provided using any combination of web browsers and dedicated applications running on a mobile device.

Figure 15:
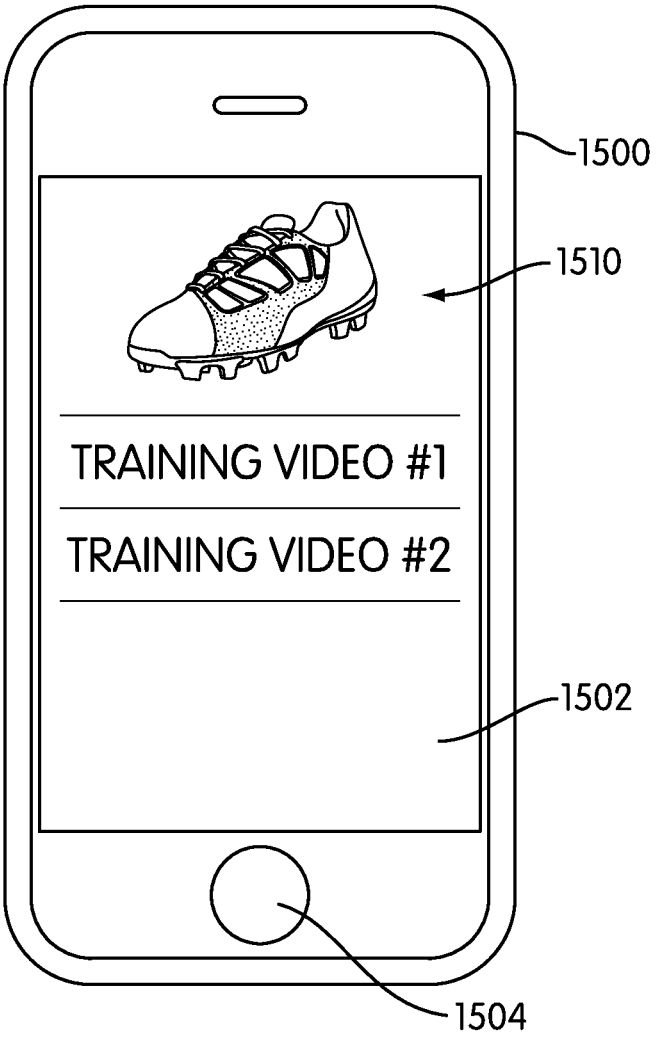
FIG. 15 is a schematic view of a portable computing device that may be used for viewing a training video.

FIG. 15 illustrates a schematic view of an embodiment of a training system that utilizes one or more features of mobile device 1500. Generally, a mobile device could be any device that is portable and that may be used by an athlete or user to obtain training instructions. Examples of different mobile devices include, but are not limited to: mobile phones, digital music players, portable digital assistants (PDAs), portable gaming machines, ultraportable laptops as well as any other kinds of mobile devices. In the exemplary embodiment, mobile device 1500 may be an iPhone or iPod manufactured by Apple Computer, Inc.

Mobile device 1500 can be configured with display screen 1502. Also, mobile device 1500 can include input button 1504. Furthermore, in some cases, mobile device 1500 can be configured with a touch-sensitive screen. In other cases, mobile device 1500 can include any other input devices. It will be understood that mobile device 1500 can include various other provisions including speakers, a microphone, ports for syncing and/or powering mobile device 1500, a headphone jack as well as various other provisions which are not visible in FIG. 15.

Mobile device 1500 can be configured to run one or more software applications. In some cases, software applications can be provided on mobile device 1500 at the time of manufacturing. In other cases, software applications can be downloaded from a service provider. In one exemplary embodiment, a user may purchase an application from an online retail store such as iTunes.

Mobile device 1500 may be configured to run training application 1510. In some cases, training application 1510 may be a software application that provides a user with various training videos including any of the videos that are accessible in the website described above. In some cases, upon loading training application 1510, a user may be prompted to select the desired training video.

In some embodiments, a training application may be designed for a particular type of footwear. For example, in the current embodiment, training application 1510 may be designed to provide training instructions for training an athlete to kick a ball using articles of footwear with ball control portions. In other embodiments, a training application could be configured with training instructions for multiple different kinds of footwear. In such cases, upon loading the training application, a user could be prompted to select the desired type of footwear for training.

Figure 16:
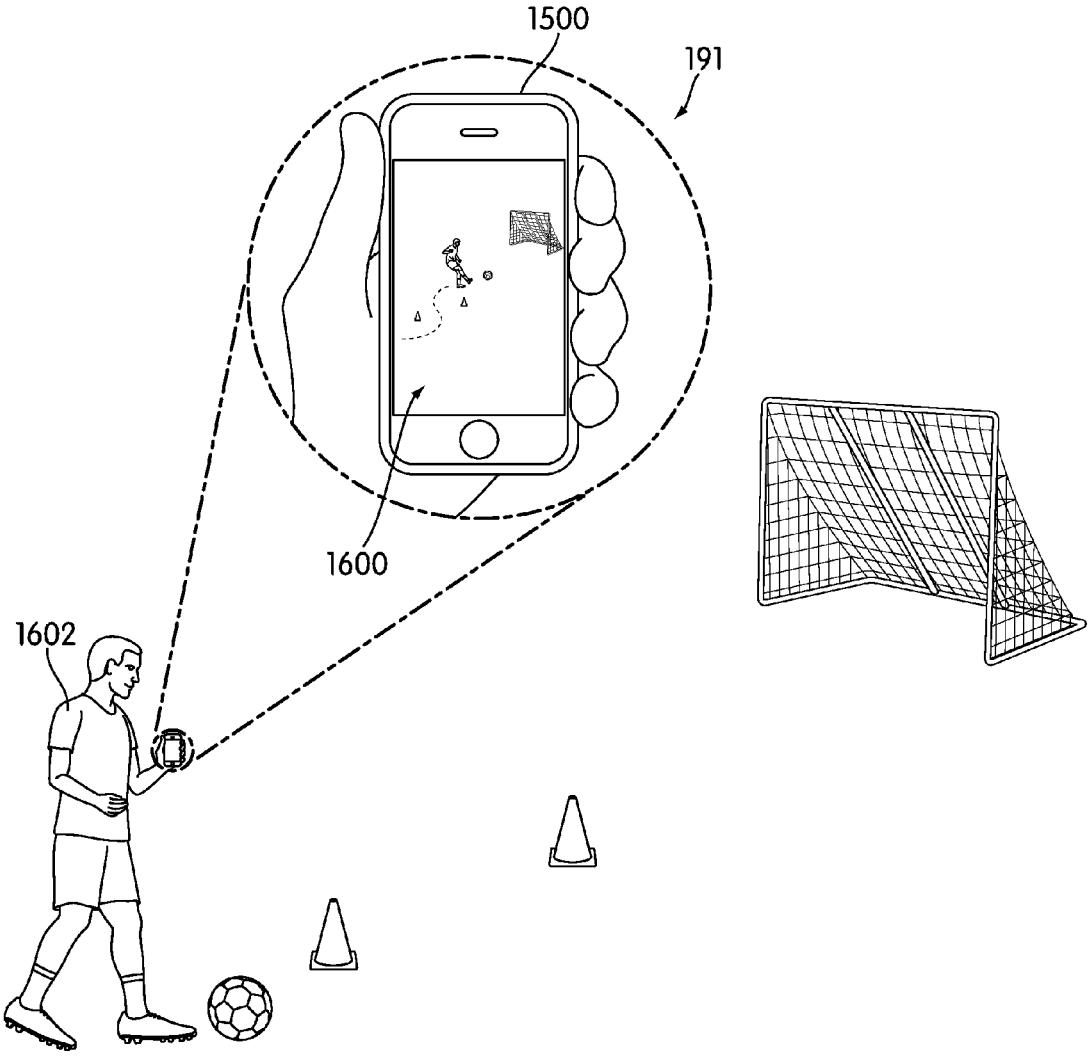
FIG. 16 is a schematic view of an embodiment of an athlete using a portable computing device during training.

FIG. 16 illustrates an embodiment of training system 191 incorporating the use of mobile device 1500. In this case, athlete 1602 is able to view training video 1600 on mobile device 1500. This allows athlete 1602 to receive training instructions while participating in a training activity. Although the current embodiment illustrates athlete 1602 holding mobile device 1500 during a training exercise, in other embodiments athlete 1602 may not hold mobile device 1500 during the training exercise. With this arrangement, athlete 1602 is able to receive training instructions in various different situations.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of using an article of footwear, comprising the steps of:

receiving training instructions; and in accordance with the training instructions, moving along a predetermined path and kicking a ball by contacting the ball with a ball control portion of the article of footwear, the ball control portion comprising a plurality of protrusions that are configured to bend;

each protrusion of the plurality of protrusions including a major axis, a minor axis and a normal axis, the normal axis being approximately perpendicular to the major axis and the minor axis;

each protrusion of the plurality of protrusions further including a planar gripping portion that extends in a direction along the major axis and in a direction along the normal axis; and wherein the plurality of protrusions are disposed in an arc-like configuration along an arc;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

2. The method according to claim 1, wherein the training instructions are provided in a written format.

3. The method according to claim 1, wherein the training instructions are provided in a video format.

4. The method according to claim 1, wherein the training instructions are provided in an audible format.

5. The method according to claim 1, wherein the training instructions are provided in a training kit, the training kit including the article of footwear.

6. The method according to claim 1, wherein the training instructions provide instructions for training multiple athletes simultaneously.

7. A method of using an article of footwear, comprising the steps of:

receiving training instructions; and in accordance with the training instructions, dribbling a ball around at least one marker and kicking the ball with a ball control portion of the article of footwear, the ball control portion comprising a plurality of protrusions that are configured to bend;

each protrusion of the plurality of protrusions including a major axis, a minor axis and a normal axis, the normal axis being approximately perpendicular to the major axis and the minor axis;

each protrusion of the plurality of protrusions further including a planar gripping portion that extends in a direction along the major axis and in a direction along the normal axis; and wherein the plurality of protrusions are configured to bend in a manner so that the gripping portions confront a surface of the ball during the kick;

wherein the plurality of protrusions are disposed in an arc-like configuration along an arc extending from a forefoot region of the upper to a midfoot region of the upper;

wherein the arc extends from the midfoot region proximate a sole structure of the article of footwear to the forefoot region, the arc also extending in an upward direction as the arc proceeds toward the forefoot region;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

8. The method according to claim 7, wherein the set of instructions are provided on removable media.

9. The method according to claim 7, wherein the training instructions are provided in an instruction booklet.

10. The method according to claim 7, wherein the training instructions are provided on a website.

11. The method according to claim 7, wherein the training instructions are provided in a software application.

12. The method according to claim 7, wherein the training instructions are configured to be accessed on a computer.

13. The method according to claim 7, wherein the training instructions are configured to be accessed on a mobile device.

14. A method of using an article of footwear, comprising the steps of:

receiving training instructions;

in accordance with the training instructions, moving along a predetermined path, the predetermined path being determined from the training instructions;

kicking a ball by contacting the ball with a ball control portion of the article of footwear, the ball control portion comprising a plurality of protrusions that are configured to bend;

each protrusion of the plurality of protrusions including a major axis, a minor axis and a normal axis, the normal axis being approximately perpendicular to the major axis and the minor axis;

each protrusion of the plurality of protrusions further including a planar gripping portion that extends in a direction along the major axis and in a direction along the normal axis; and wherein the major axes of some protrusions of the plurality of protrusions are aligned with a curve on a surface of a ball when the ball control portion contacts the ball during a kick;

wherein the protrusions aligned with the curve on a surface of a ball when the ball control portion contacts the ball during a kick are disposed in an arc-like configuration along an arc extending from a forefoot region of the upper to a midfoot region of the upper;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

15. The method according to claim 14, wherein the training instructions and the article of footwear are received in a training kit.

16. The method according to claim 14, wherein the method includes a step of using a computing device to read digital information related to the training instructions.

17. The method according to claim 14, wherein the method includes a step of receiving the training instructions from a website.

18. The method according to claim 14, wherein the method includes a step of reading an instruction booklet that includes the training instructions.

19. The method according to claim 14, wherein the method includes a step of downloading a training application onto a mobile device, the training application including information about the training instructions.

20. The method according to claim 14, wherein the method includes a step of watching a training video, the training video including information about the training instructions.

* * * * *